US008947328B2

(12) United States Patent
Kimura

(10) Patent No.: US 8,947,328 B2
(45) Date of Patent: Feb. 3, 2015

(54) LIGHT EMITTING DEVICE AND METHOD OF DRIVING THE SAME

(75) Inventor: Hajime Kimura, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 912 days.

(21) Appl. No.: 11/101,330

(22) Filed: Apr. 7, 2005

(65) Prior Publication Data

US 2005/0179628 A1 Aug. 18, 2005

Related U.S. Application Data

(62) Division of application No. 10/235,734, filed on Sep. 5, 2002, now Pat. No. 7,088,052.

(30) Foreign Application Priority Data

Sep. 7, 2001 (JP) ..... 2001-271424

(51) Int. Cl.
*G09G 3/32* (2006.01)

(52) U.S. Cl.
CPC ..... *G09G 3/3233* (2013.01); *G09G 3/3291* (2013.01); *G09G 2300/0842* (2013.01); *G09G 2310/0251* (2013.01); *G09G 2320/02* (2013.01); *G09G 2320/0257* (2013.01);
(Continued)

(58) Field of Classification Search
USPC ..... 345/60, 63, 64, 74.1, 75.1, 75.2, 76, 77, 345/78, 79, 80, 81, 82, 83, 89, 90, 92, 94, 345/95, 96, 98, 99, 100, 101, 204, 205, 206, 345/207, 208, 209, 210, 214, 690, 691, 696, 345/693; 315/169.1, 169.2, 169.3, 169.4
See application file for complete search history.

(56) References Cited

U.S. PATENT DOCUMENTS 5,245,326 A * 9/1993 Zalph ..... 345/92
5,659,328 A * 8/1997 Todokoro et al. ..... 345/74.1
5,659,329 A * 8/1997 Yamanobe et al. ..... 345/74.1
(Continued)

FOREIGN PATENT DOCUMENTS

EP 0 688 035 A1 12/1995
EP 0 905 673 3/1999
(Continued)

OTHER PUBLICATIONS

Office Action re Korean application No. KR 10-2011-0042484, dated Jun. 1, 2011 (with English translation).
(Continued)

*Primary Examiner* — Kent Chang
*Assistant Examiner* — Sujit Shah
(74) *Attorney, Agent, or Firm* — Husch Blackwell LLP

(57) ABSTRACT

The present invention specifies the characteristic of a driving transistor provided in a pixel and corrects a video signal to be inputted to the pixel based on the specification. As a result, a light emitting device and its driving method in which influence of fluctuation in characteristic among transistors is removed to obtain clear multi-gray scale are provided. The present invention can also provide a light emitting device and its driving method in which a change with age in amount of current flowing between two electrodes of a light emitting element is reduced to obtain clear multi-gray scale display.

6 Claims, 16 Drawing Sheets

(52) U.S. Cl.
CPC . *G09G 2320/0285* (2013.01); *G09G 2320/029* (2013.01); *G09G 2320/0295* (2013.01); *G09G 2320/043* (2013.01)
USPC ..... 345/77; 345/204; 345/205; 345/82

(56) References Cited

U.S. PATENT DOCUMENTS

| | | | | |
|---|---|---|---|---|
| 5,734,361 | A * | 3/1998 | Suzuki et al. | 345/74.1 |
| 5,793,344 | A | 8/1998 | Koyama | |
| 5,886,474 | A | 3/1999 | Asai et al. | |
| 5,949,194 | A * | 9/1999 | Kawakami et al. | 315/169.4 |
| 5,949,393 | A * | 9/1999 | Sakai et al. | 345/74.1 |
| 6,060,840 | A | 5/2000 | Foo et al. | |
| 6,144,166 | A * | 11/2000 | Nakamura et al. | 315/169.3 |
| 6,144,350 | A * | 11/2000 | Fujii et al. | 345/74.1 |
| 6,177,767 | B1 | 1/2001 | Asai et al. | |
| 6,184,851 | B1 * | 2/2001 | Yamaguchi et al. | 345/75.2 |
| 6,188,454 | B1 | 2/2001 | Greene et al. | 349/74 |
| 6,204,610 | B1 | 3/2001 | Komiya | 315/169.3 |
| 6,229,508 | B1 * | 5/2001 | Kane | 345/82 |
| 6,236,167 | B1 * | 5/2001 | Yamaguchi et al. | 315/169.2 |
| 6,246,180 | B1 | 6/2001 | Nishigaki | 315/169.3 |
| 6,262,701 | B1 * | 7/2001 | Okuda et al. | 345/74.1 |
| 6,275,061 | B1 | 8/2001 | Tomita | 324/770 |
| 6,297,791 | B1 | 10/2001 | Naito et al. | |
| 6,317,138 | B1 | 11/2001 | Yano et al. | |
| 6,339,414 | B1 * | 1/2002 | Todokoro et al. | 345/75.1 |
| 6,346,773 | B1 * | 2/2002 | Takegami | 315/169.1 |
| 6,384,804 | B1 | 5/2002 | Dodabalapur et al. | |
| 6,404,139 | B1 * | 6/2002 | Sasaki et al. | 315/169.3 |
| 6,414,443 | B2 | 7/2002 | Tsuruoka et al. | |
| 6,445,367 | B1 * | 9/2002 | Suzuki et al. | 345/75.2 |
| 6,452,341 | B1 | 9/2002 | Yamauchi et al. | |
| 6,459,207 | B1 * | 10/2002 | Nomura et al. | 315/169.3 |
| 6,476,779 | B1 | 11/2002 | Yano et al. | |
| 6,489,938 | B1 | 12/2002 | Ito | 345/63 |
| 6,489,952 | B1 | 12/2002 | Tanaka et al. | |
| 6,498,592 | B1 | 12/2002 | Matthies | 345/1.1 |
| 6,501,227 | B1 | 12/2002 | Koyama | 315/169.3 |
| 6,512,469 | B1 | 1/2003 | Azami et al. | |
| 6,518,962 | B2 * | 2/2003 | Kimura et al. | 345/211 |
| 6,525,704 | B1 | 2/2003 | Kondo et al. | |
| 6,545,652 | B1 | 4/2003 | Tsuji | |
| 6,549,181 | B2 * | 4/2003 | Sakai et al. | 345/74.1 |
| 6,549,183 | B1 | 4/2003 | Koyama | |
| 6,570,611 | B1 | 5/2003 | Satou et al. | 348/189 |
| 6,580,407 | B1 * | 6/2003 | Suzuki et al. | 345/74.1 |
| 6,583,775 | B1 | 6/2003 | Sekiya et al. | |
| 6,590,581 | B1 | 7/2003 | Koyama et al. | |
| 6,606,093 | B1 * | 8/2003 | Gossett et al. | 345/441 |
| 6,618,030 | B2 * | 9/2003 | Kane et al. | 345/82 |
| 6,621,475 | B1 * | 9/2003 | Yamaguchi et al. | 345/74.1 |
| 6,630,840 | B2 | 10/2003 | Tomita | 324/765 |
| 6,633,301 | B1 * | 10/2003 | Dallas et al. | 345/597 |
| 6,635,505 | B2 | 10/2003 | Tanaka et al. | |
| 6,680,577 | B1 | 1/2004 | Inukai et al. | |
| 6,700,330 | B2 | 3/2004 | Koyama | 315/169.3 |
| 6,707,437 | B1 * | 3/2004 | Kuno et al. | 345/74.1 |
| 6,710,548 | B2 * | 3/2004 | Kimura | 315/169.3 |
| 6,714,190 | B2 * | 3/2004 | Nakano | 345/204 |
| 6,750,792 | B2 | 6/2004 | Azami et al. | |
| 6,753,854 | B1 | 6/2004 | Koyama et al. | |
| 6,844,683 | B2 | 1/2005 | Yamauchi et al. | |
| 6,847,342 | B2 | 1/2005 | Tsuji | |
| 6,878,027 | B1 * | 4/2005 | Kawasaki | 445/6 |
| 6,947,060 | B2 * | 9/2005 | Abe | 345/691 |
| 6,987,497 | B2 | 1/2006 | Koyama | |
| 7,009,590 | B2 | 3/2006 | Numao | |
| 7,042,427 | B2 * | 5/2006 | Inukai | 345/77 |
| 7,046,220 | B2 * | 5/2006 | Tagawa et al. | 345/76 |
| 7,049,983 | B2 | 5/2006 | Azami et al. | |
| 7,061,186 | B2 | 6/2006 | Inukai et al. | |
| 7,173,582 | B2 * | 2/2007 | Nishitoba et al. | 345/76 |
| 7,198,967 | B2 | 4/2007 | Tanaka et al. | |
| 7,227,519 | B1 | 6/2007 | Kawase et al. | |
| 7,312,572 | B2 | 12/2007 | Yamauchi et al. | |
| 7,362,322 | B2 | 4/2008 | Kimura et al. | |
| 7,432,919 | B2 * | 10/2008 | Inoue et al. | 345/204 |
| 7,446,737 | B2 * | 11/2008 | Maede et al. | 345/76 |
| 7,456,579 | B2 * | 11/2008 | Yamazaki et al. | 315/169.3 |
| 2001/0024186 | A1 | 9/2001 | Kane et al. | 345/98 |
| 2001/0045929 | A1 * | 11/2001 | Prache et al. | 345/89 |
| 2002/0024481 | A1 | 2/2002 | Kawabe et al. | 345/87 |
| 2002/0030647 | A1 * | 3/2002 | Hack et al. | 345/82 |
| 2002/0101168 | A1 * | 8/2002 | Nomura et al. | 315/169.3 |
| 2003/0025717 | A1 * | 2/2003 | Nakano | 345/690 |
| 2003/0095085 | A1 * | 5/2003 | Abe | 345/74.1 |
| 2005/0073242 | A1 | 4/2005 | Yamauchi et al. | |
| 2006/0109231 | A1 | 5/2006 | Koyama | |
| 2006/0192699 | A1 | 8/2006 | Azami et al. | |
| 2007/0166860 | A1 | 7/2007 | Tanaka et al. | |
| 2008/0116458 | A1 | 5/2008 | Yamauchi et al. | |

FOREIGN PATENT DOCUMENTS

| | | | | |
|---|---|---|---|---|
| EP | 0 923 067 | A1 | 6/1999 | |
| EP | 923067 | A1 * | 6/1999 | G09G 3/30 |
| EP | 1 003 151 | A2 | 5/2000 | |
| EP | 1 005 013 | A1 | 5/2000 | |
| EP | 1 026 656 | A2 | 8/2000 | |
| EP | 1 061 497 | A1 | 12/2000 | |
| EP | 1 063 704 | A2 | 12/2000 | |
| EP | 1 067 505 | A2 | 1/2001 | |
| EP | 1 103 947 | A2 | 5/2001 | |
| EP | 1 128 439 | A2 | 8/2001 | |
| EP | 1 225 557 | A1 | 7/2002 | |
| EP | 1 594 117 | A2 | 11/2005 | |
| EP | 1 612 764 | A2 | 1/2006 | |
| JP | 4-285994 | | 10/1992 | |
| JP | 7-261719 | | 10/1995 | |
| JP | 08-234696 | A | 9/1996 | |
| JP | 9-16125 | | 1/1997 | |
| JP | 9-115673 | | 5/1997 | |
| JP | 9-198007 | | 7/1997 | |
| JP | 9-318929 | | 12/1997 | |
| JP | 10-031449 | | 2/1998 | |
| JP | 10-254410 | | 9/1998 | |
| JP | 11-87053 | | 3/1999 | |
| JP | 11-219146 | | 8/1999 | |
| JP | 11-316577 | | 11/1999 | |
| JP | 11-327506 | | 11/1999 | |
| JP | 11-344949 | | 12/1999 | |
| JP | 2000-56732 | | 2/2000 | |
| JP | 2000-066633 | | 3/2000 | |
| JP | 2000-187464 | | 7/2000 | |
| JP | 2000-221942 | | 8/2000 | |
| JP | 2000-259110 | | 9/2000 | |
| JP | 2000-267628 | | 9/2000 | |
| JP | 2000-338920 | | 12/2000 | |
| JP | 2000-347598 | | 12/2000 | |
| JP | 2000-347621 | | 12/2000 | |
| JP | 2001-13908 | | 1/2001 | |
| JP | 2001-022323 | | 1/2001 | |
| JP | 2001-27891 | | 1/2001 | |
| JP | 2001-60076 | | 3/2001 | |
| JP | 2001-67018 | | 3/2001 | |
| JP | 2001-134252 | | 5/2001 | |
| JP | 2001-134754 | | 5/2001 | |
| JP | 2001-142426 | | 5/2001 | |
| JP | 2001-159878 | | 6/2001 | |
| JP | 2001-166737 | | 6/2001 | |
| JP | 2001-184016 | | 7/2001 | |
| JP | 2001-215917 | | 8/2001 | |
| JP | 2001-222240 | | 8/2001 | |
| JP | 2001-222259 | | 8/2001 | |
| JP | 2001-223074 | | 8/2001 | |
| JP | 2001-231053 | | 8/2001 | |
| JP | 2001-343933 | | 12/2001 | |
| JP | 2001-350442 | | 12/2001 | |
| KR | 1999-0088200 | A | 12/1999 | |
| KR | 2000-0035688 | | 6/2000 | |
| KR | 2001-0029903 | | 4/2001 | |
| KR | 2002-0087856 | A | 11/2002 | |
| WO | WO 98/40871 | A1 | 9/1998 | |

(56) References Cited

FOREIGN PATENT DOCUMENTS

| | | |
|---|---|---|
| WO | WO-00/49636 | 8/2000 |
| WO | WO 00/77533 | 12/2000 |
| WO | WO 01/26085 | 4/2001 |

OTHER PUBLICATIONS

Office Action re Korean application No. KR 10-2009-0067326, dated Apr. 22, 2010 (with English translation).

Office Action re Korean application No. KR 10-2011-0004123, dated Feb. 7, 2011 (with English translation).

Office Action re Korean application No. KR 2010-0091755, dated Oct. 18, 2010 (with English translation).

Office Action re Korean application No. KR 10-2103-0044446, dated Jun. 17, 2013 (with English translation).

* cited by examiner

LIGHT EMITTING DEVICE AND METHOD OF DRIVING THE SAME

This application is a divisional of U.S. application Ser. No. 10/235,734 filed on Sep. 5, 2002 now U.S. Pat. No. 7,088, 052.

BACKGROUND OF THE INVENTION

1. Field of the Invention

The present invention relates to a light emitting device in which a light emitting element and a transistor for controlling the light emitting element are provided on a semiconductor substrate or an insulating surface, and to a method of driving the light emitting device. More specifically, the invention relates to a light emitting device and method of driving the same in which influence of fluctuation in characteristic of transistors which control light emitting elements is removed. The present invention belongs to a technical field related to a light emitting device using a semiconductor element such as a transistor.

2. Description of the Related Art

In recent years, development of light emitting devices using light emitting elements (image display devices) is being advanced. Light emitting devices are roughly divided into passive type and active type. Active light emitting devices each have a light emitting element and a transistor for controlling the light emitting element on an insulating surface.

Transistors using polysilicon films are higher in field effect mobility (also called mobility) than conventional transistors that are formed of amorphous silicon films, and therefore can operate at higher speed than the transistors formed of amorphous silicon films. For that reason, control of pixels, which has conventionally been carried out by a driving circuit external to the substrate, can be conducted by a driving circuit formed on the same insulating surface where the pixels are formed. Such active light emitting devices obtain various advantages including reduction in production cost, reduction in size, a rise in yield, and improvement of throughput by building various kinds of circuits and elements on the same insulating surface.

Major driving methods of active light emitting devices are analog methods and digital methods. The former methods, namely, the analog methods control a current flowing into a light emitting element to control the luminance and obtain gray scale. On the other hand, the latter methods, namely, the digital methods drive the devices by switching between only two states, ON state in which a light emitting element is ON (the luminance thereof is almost 100%) and OFF state in which the light emitting element is OFF (the luminance thereof is almost 0%). This allows only two gray scales and, therefore, techniques for obtaining multi-gray scale by combining this with a time gray scale method, an area ratio gray scale, or the like have been proposed for the digital methods.

Now, a detailed description will be given with reference to FIG. 14 and FIGS. 15A and 15B on a method of driving a light emitting device. The structure of the light emitting device is described first referring to FIG. 14. FIG. 14 shows an example of circuit diagram of a pixel portion 1800 in the light emitting device. Gate signal lines (G1 to Gy), which transmit gate signals supplied from a gate signal line driving circuit to pixels, are connected to gate electrodes of switching transistors. The switching transistors are provided in the respective pixels and each denoted by 1801. The switching transistor 1801 of each pixel has a source region and a drain region one of which is connected to one of source signal lines (S1 to Sx) for inputting video signals and the other of which is connected to a gate electrode of a driving transistor 1804 of each pixel and to a capacitor 1808 of each pixel.

The driving transistor 1804 of each pixel has a source region connected to one of power supply lines (V1 to Vx) and has a drain region connected to a light emitting element 1806. The electric potential of the power supply lines (V1 to Vx) is called a power supply electric potential. Each of the power supply lines (V1 to Vx) is connected to the capacitor 1808 of each pixel.

The light emitting element 1806 has an anode, a cathode, and an organic compound layer interposed between the anode and the cathode. If the anode of the light emitting element 1806 is connected to the drain region of the driving transistor 1804, the anode serves as a pixel electrode while the cathode of the light emitting element 1806 serves as an opposite electrode. On the other hand, if the cathode of the light emitting element 1806 is connected to the drain region of the driving transistor 1804, the anode of the light emitting element 1806 serves as the opposite electrode whereas the cathode serves as the pixel electrode.

The electric potential of the opposite electrode is called an opposite electric potential and a power supply that gives the opposite electric potential to the opposite electrode is called an opposite power supply. The difference between the electric potential of the pixel electrode and the electric potential of the opposite electrode is a drive voltage, and the drive voltage is applied to the organic compound layer.

FIGS. 15A and 15B are timing charts for when the light emitting device of FIG. 14 is driven by an analog method. In FIGS. 15A and 15B, a period starting with selection of one gate signal line and ending with selection of the next gate signal line is called one line period (L). A period started as one image is displayed and ended as the next image is displayed is called one frame period (F). The light emitting device of FIG. 14 has y gate signal lines and therefore y line periods (L1 to Ly) are provided in one frame period.

The power supply lines (V1 to Vx) are held at a constant power supply electric potential. The opposite electric potential that is the electric potential of the opposite electrode is also kept constant. The opposite electric potential is set such that the difference between it and the power supply electric potential is large enough to cause the light emitting element to emit light.

In the first line period (L1), the gate signal line (G1) is selected by a gate signal supplied from the gate signal line driving circuit. A gate signal line being selected means that a transistor whose gate electrode is connected to the gate signal line is turned ON.

Then analog video signals are inputted sequentially to the source signal lines (S1 to Sx). Since every switching transistor 1801 that is connected to the gate signal line (G1) is turned ON, the video signals inputted to the source signal lines (S1 to Sx) are inputted to the gate electrode of the driving transistor 1804 through the switching transistor 1801.

The amount of current flowing in a channel formation region of the driving transistor 1804 is controlled by the level of electric potential (voltage) of a signal inputted to the gate electrode of the driving transistor 1804. Therefore, the level of electric potential applied to the pixel electrode of the light emitting element 1806 is determined by the level of electric potential of the video signal inputted to the gate electrode of the driving transistor 1804. In short, a current flow in the light emitting element 1806 in an amount according to the level of electric potential of a video signal and the light emitting element 1806 emits light in accordance with this current amount.

The operation described above is repeated until inputting video signals to the source signal lines (S1 to Sx) is completed. This is the end of the first line period (L1). Then the second line period (L2) is started and the gate signal line (G2) is selected by a gate signal. Similar to the first line period (L1), video signals are sequentially inputted to the source signal lines (S1 to Sx).

The above operation is repeated until inputting gate signals to all the gate signal lines (G1 to Gy) is completed, thereby ending one frame period. During one frame period, all pixels are used to form an image for display.

As has been described, a method which uses a video signal to control the amount of current flowing into a light emitting element and in which the gray scale is determined in accordance with the current amount is a driving method called an analog type. In short, the gray scale is determined in accordance with the electric potential of a video signal inputted to a pixel in the analog driving method.

On the other hand, in a digital driving method, multi-gray scale is obtained in combination with a time gray scale method or the like as described above. In a digital driving method combined with a time gray scale method, the gray scale is determined in accordance with the length of a period in which a current flows between two electrodes of a light emitting element (a detailed timing chart of this is not provided).

Described next with reference to FIGS. 11A to 13 is voltage-current characteristics of the driving transistor 1804 and light emitting element 1806. FIG. 11A shows the driving transistor 1804 and the light emitting element 1806 alone out of the pixel shown in FIG. 14. FIG. 11B shows voltage-current characteristics of the driving transistor 1804 and light emitting element 1806 of FIG. 11A. The voltage-current characteristic graph of the driving transistor 1804 in FIG. 11B shows the amount of current flowing in the drain region of the driving transistor 1804 in relation to a voltage $V_{DS}$ between the source region and the drain region. FIG. 12 shows plural voltage-current characteristic curves different from each other in $V_{GS}$ that is a voltage between the source region and gate electrode of the driving transistor 1804.

As shown in FIG. 11A, a voltage applied between the pixel electrode and opposite electrode of the light emitting element 1806 is given as $V_{EL}$, and a voltage applied between a terminal 3601 that is connected to the power supply line and the opposite electrode of the light emitting element 1806 is given as $V_T$. The value of $V_T$ is fixed by the electric potential of the power supply lines (V1 to Vx). $V_{DS}$ represents a voltage between the source region and drain region of the driving transistor 1804, and $V_{GS}$ represents a voltage between a wire 3602 connected to the gate electrode of the driving transistor 1804 and the source region, namely, a voltage between the gate electrode and source region of the driving transistor 1804.

The driving transistor 1804 and the light emitting element 1806 are connected to each other in series. This means that the same amount of current flows in the elements (the driving transistor 1804 and the light emitting element 1806). Therefore the driving transistor 1804 and light emitting element 1806 shown in FIG. 11A are driven at intersections (operation points) of the curves that indicate the voltage-current characteristics of the elements. In FIG. 11B, $V_{EL}$ corresponds to a voltage between the electric potential of the opposite electrode 1809 and the electric potential at the operation point. $V_{DS}$ corresponds to a voltage between the electric potential of the driving transistor 1804 at the terminal 3601 and the electric potential of 1804 at the operation point. Accordingly, $V_T$ is equal to the sum of $V_{EL}$ and $V_{DS}$.

Here, consider a case in which $V_{GS}$ is changed. As can be seen in FIG. 11B, the amount of current flowing into the driving transistor 1804 is increased as $|V_{GS}-V_{TH}|$ of the driving transistor 1804 is increased, in other words, as $|V_{GS}|$ is increased. $V_{TH}$ represents the threshold voltage of the driving transistor 1804. Therefore, as FIG. 11B shows, a rise in $|V_{GS}|$ is naturally followed by an increase in amount of current flowing in the light emitting element 1806 at an operation point. The luminance of the light emitting element 1806 is raised in proportion to the amount of current flowing in the light emitting element 1806.

When the amount of current flowing in the light emitting element 1806 is increased accompanying a rise in $|V_{GS}|$, $V_{EL}$ is accordingly increased. When $V_{EL}$ is increased, $V_{DS}$ is reduced that much since $V_T$ is a fixed value determined by the electric potential of the power supply lines (V1 to Vx).

As shown in FIG. 11B, a voltage-current characteristic curve of the driving transistor 1804 can be divided into two ranges by the values of $V_{GS}$ and $V_{DS}$. A range in which $|V_{GS}-V_{TH}|<|V_{DS}|$ is a saturation range, and a range in which $|V_{GS}-V_{TH}|>|V_{DS}|$ is a linear range.

In the saturation range, the following expression (1) is satisfied. $I_{DS}$ is given as the amount of current flowing in the channel formation region of the driving transistor 1804. $\beta=\mu C_o W/L$, wherein $\mu$ represents the mobility of the driving transistor 1804, $C_o$ represents the gate capacitance per unit area, and W/L represents the ratio of a channel width W of the channel formation region to its channel length L.

[Mathematical Expression 1]

$$I_{DS}=\beta(V_{GS}-V_{TH})^2 \quad (1)$$

In the linear range, the following expression (2) is satisfied.

[Mathematical Expression 2]

$$I_{DS}=\beta\{(V_{GS}-V_{TH})V_{DS}-V_{DS}^2\} \quad (2)$$

It is understood from the expression (1) that the current amount in the saturation range is hardly changed by $V_{DS}$ but is determined solely by $V_{GS}$.

It is understood from the expression (2) that the current amount in the linear range is determined by $V_{DS}$ and $V_{GS}$. As $|V_{GS}|$ is increased, the driving transistor 1804 comes to operate in the linear range. $V_{EL}$ is also increased gradually. Accordingly, $V_{DS}$ is reduced as much as $V_{EL}$ is increased. When $V_{DS}$ is reduced, the current amount is also reduced in the linear range. For that reason, the current amount is not easily increased despite an increase in $|V_{GS}|$. The current amount reaches $I_{MAX}$ when $|V_{GS}|=\infty$. In other words, a current larger than $I_{MAX}$ does not flow no matter how large $|V_{GS}|$ is. $I_{MAX}$ represents the amount of current flowing in the light emitting element 1806 when $V_{EL}=V_T$.

By controlling the level of $|V_{GS}|$ in this way, the operation point can be moved to the saturation range, or to the linear range.

Ideally, every driving transistor 1804 has the same characteristic. However, in reality, the threshold voltage $V_{TH}$ and the mobility $\mu$ often vary from one driving transistor 1804 to another. When the threshold voltage $V_{TH}$ and the mobility $\mu$ vary from one driving transistor 1804 to another, as the expressions (1) and (2) show, the amount of current flowing in the channel formation region of the driving transistor 1804 fluctuates even though $V_{GS}$ is the same.

FIG. 12 shows the voltage-current characteristic of the driving transistor 1804 whose threshold voltage $V_{TH}$ and mobility p are deviated from ideal ones. A solid line 3701 indicates the ideal voltage-current characteristic curve. 3702 and 3703 each indicate the voltage-current characteristic of the driving transistor 1804 whose threshold $V_{TH}$ and mobility μ differ from ideal ones.

The voltage-current characteristic curves 3702 and 3703 in the saturation range deviate from the ideal current-voltage characteristic curve 3701 by the same current amount $\Delta I_A$. An operation point 3705 of the voltage-current characteristic curve 3702 is in the saturation range whereas an operation point 3706 of the voltage-current characteristic curve 3703 is in the linear range. In this case, the current amount at the operation point 3705 and the current amount at the operation point 3706 are shifted from the current amount at an operation point 3704 of the ideal voltage-current characteristic curve 3701 by $\Delta I_B$ and $\Delta I_C$, respectively. $\Delta I_C$ at the operation point 3706 in the linear range is smaller than $\Delta I_B$ at the operation point 3705 in the saturation range.

To conclude the above operation analysis, a graph of current amount in relation to the gate voltage $|V_{GS}|$ of the driving transistor 1804 is shown in FIG. 13. When $|V_{GS}|$ is increased until it exceeds the absolute value of the threshold voltage of the driving transistor 1804, namely, $|V_{TH}|$, the driving transistor 1804 is turned conductive and a current starts to flow. If $|V_{GS}|$ is further increased, $|V_{GS}|$ reaches a value that satisfies $|V_{GS}-V_{TH}|=|V_{DS}|$ (here, the value is denoted by A) and the curve leaves the saturation range to enter the linear range. If $|V_{GS}|$ is increased still further, the current amount increases and finally reaches saturation. At this point, $|V_{GS}|=\infty$.

As can be understood from FIG. 13, almost no current flows in a range where $|V_{GS}|\leq V_{TH}|$. A range in which $|V_{TH}|\leq|V_{GS}|\leq A$ is satisfied is called a saturation range and the current amount is changed by $|V_{GS}|$ in this range. This means that, if the voltage applied to the light emitting element 1806 in the saturation range is changed even slightly, the amount of current flowing in the light emitting element 1806 is changed exponentially. The luminance of the light emitting element 1806 is raised almost in proportion to the amount of current flowing in the light emitting element 1806. To summarize, the device mainly operates in the saturation range in an analog driving method that controls the amount of current flowing into the light emitting element in accordance with $|V_{GS}|$ to control the luminance and obtain gray scale.

On the other hand, a range where $A\leq|V_{GS}|$ in FIG. 13 is the linear range and the amount of current flowing into the light emitting element is changed by $|V_{GS}|$ and $|V_{DS}|$ in this range. In the linear range, the amount of current flowing in the light emitting element 1806 is not changed much when the level of voltage applied to the light emitting element 1806 is changed. A digital driving method drives the device by switching between only two states, ON state in which the light emitting element is ON (the luminance thereof is almost 100%) and OFF state in which the light emitting element is OFF (the luminance thereof is almost 0%). When the device operates in the range where $A\leq|V_{GS}|$ in order to turn the light emitting element ON, the current value approaches $I_{MAX}$ without fail and the luminance of the light emitting element reaches almost 100%. On the other hand, when the device operates in the range where $|V_{TH}\geq|V_{GS}|$ in order to turn the light emitting element OFF, the current value is almost 0 and the luminance of the light emitting element reaches almost 0%. In short, a light emitting device driven by a digital method mainly operates in ranges where $|V_{TH}|\geq|V_{GS}|$ and $A\leq|V_{GS}|$.

In a light emitting device driven by an analog method, when a switching transistor is turned ON, an analog video signal inputted to a pixel turns into a gate voltage of a driving transistor. At this point, the electric potential of a drain region of the driving transistor is determined in accordance with the voltage of the analog video signal inputted to a gate electrode of the driving transistor and a given drain current flows into a light emitting element. The light emitting element emits light in an amount (at a luminance) according to the drain current amount. The light emission amount of a light emitting element is controlled as described above, thereby obtaining gray scale display.

However, the analog method described above has such a drawback that it is very weak against fluctuation in characteristic among driving transistors. With driving transistors of the respective pixels fluctuated in characteristic, it is impossible to supply the same amount of drain current even when the same level of gate voltage is applied to the driving transistors. In other words, the slightest fluctuation in characteristic among driving transistors causes light emitting elements to emit light in greatly varying amount even though the light emitting elements receive a video signal of the same voltage level.

Analog driving methods are thus responsive to fluctuation in characteristic among driving transistors and it has been a liability in gray scale display by conventional active light emitting devices.

If a light emitting device is driven by a digital method in order to deal with fluctuation in characteristic among driving transistors, the amount of current flowing into an organic compound layer of a light emitting element is changed accompanying degradation of the organic compound layer.

This is because light emitting elements are degraded with age by nature. Voltage-current characteristic curves of a light emitting element before and after degradation are shown in the graph of FIG. 18A. In a digital driving method, a light emitting device operates in a linear range as described above. When a light emitting element is degraded, its voltage-current characteristic curve is changed as shown in FIG. 18A to shift its operation point. This causes a change in amount of current flowing between two electrodes of the light emitting element.

SUMMARY OF THE INVENTION

The present invention has been made in view of the above-mentioned problems, and an object of the present invention is therefore to provide a light emitting device and its driving method in which the light emitting device is driven by an analog method and influence of fluctuation in characteristic among transistors is removed to obtain clear multi-gray scale display. Another object of the present invention is to provide electronic equipment having the light emitting device as its display device.

Still another object of the present invention is to provide a light emitting device and its driving method in which a change with age in amount of current flowing between two electrodes of a light emitting element is reduced to obtain clear multi-gray scale display. Yet still another object of the present invention is to provide electronic equipment having the light emitting device as its display device.

In light of the above circumstances, the present invention provides a light emitting device and its driving method in which influence of fluctuation in characteristic among driving transistors is removed by specifying the characteristic of a driving transistor provided in a pixel and by correcting a video signal to be inputted to the pixel based on the specification.

The present invention utilizes the fact that the light emission amount (luminance) of a light emitting element is controlled by the amount of current flowing into the light emitting element. In other words, it is possible to have a light emitting element emit light in a desired amount if the light emitting element receives a desired amount of current. Therefore, a video signal suited to the characteristic of a driving transistor of each pixel is inputted to each pixel so that a desired amount of current flows into each light emitting element. This way a light emitting element can emit light in a desired amount without being influenced by fluctuation in characteristic among driving transistors.

Described below is the key of the present invention, a method of specifying the characteristic of a driving transistor. First, an ammeter is connected to a wire that supplies a current to a light emitting element to measure a current flowing into the light emitting element. For example, an ammeter is connected to a wire that supplies a current to a light emitting element, such as a power supply line or an opposite power supply line, and a current flowing into the light emitting element is measured. In measuring the current, make sure that a video signal is inputted from a source signal line driving circuit only to a specific pixel (preferably one pixel but plural specific pixels are also possible) and no current flows in light emitting elements of other pixels. This way the ammeter can measure a current flowing only in a specific pixel. If video signals of different voltage values are inputted, plural current values associated with the video signals of different voltage values can be measured for the respective pixels.

In the present invention, video signals are denoted by P ($P_1$, $P_2$, . . . , $P_n$, n is a natural number at least equal to or larger than 2). Current values Q ($Q_1$, $Q_2$, . . . , $Q_n$) corresponding to the video signals P ($P_1$, $P_2$, . . . , $P_n$) are obtained by calculating differences between a current value $I_0$ of when every pixel in the display panel is not lit and current values $I_1$, $I_2$, . . . , $I_n$ of when only one pixel in the display panel is lit. P and Q are obtained for the respective pixels to obtain characteristics of the pixels using interpolation. Interpolation is a calculation method for obtaining approximation of a point between function values at two or more points of a function, or a method of expanding the function by providing (interpolating) a function value at a point between the two points. An expression for providing the approximation is called an interpolation expression and shown in an expression (3).

[Mathematical Expression 3]

$$Q=F(P) \tag{3}$$

The interpolation function F is obtained by substituting P and Q in the expression (3) with values of video signals P ($P_1$, $P_2$, . . . , $P_n$) measured for the respective pixels and current values Q ($Q_1$, $Q_2$, . . . , $Q_n$) corresponding to the video signals. The obtained interpolation function F is stored in a storage medium, such as a semiconductor memory or a magnetic memory, provided in the light emitting device.

To make the light emitting device display an image, video signals (P) suited to characteristics of driving transistors of the respective pixels are calculated using the interpolation function F stored in the storage medium. When the obtained video signals (P) are inputted to the pixels, a desired amount of current flows in each light emitting element to obtain a desired luminance.

The definition of light emitting device according to the present invention includes a display panel (light emitting panel) in which a pixel portion having a light emitting element and a driving circuit are sealed between a substrate and a cover member, a light emitting module obtained by mounting an IC or the like to the display panel, and a light emitting display used as a display device. In other words, "light emitting device" is a generic term for light emitting panels, light emitting modules, light emitting displays, and the like. A light emitting element is not one of components indispensable to the present invention, and a device that does not include a light emitting element is also called a light emitting device in this specification.

According to the present invention, there is provided a light emitting device including a display panel with pixels each including a light emitting element, the device characterized by comprising:

current measuring means for measuring the current value of the pixels;

calculating means for calculating the interpolation functions corresponding to the pixels utilizing the outputted current values by the current measuring means;

memory means for storing an interpolation function for each of the pixels; and signal correcting means for correcting a video signal using the interpolation function stored in the memory means.

The current measuring means has means for measuring a current flowing between two electrodes of a light emitting element, and corresponds to, for example, an ammeter or a circuit that is composed of a resistance element and a capacitor element to measure the current utilizing resistance division. The calculating means and the signal correcting means have means of calculation and correspond to a microcomputer or a CPU, for example. The memory means corresponds to a known storage medium such as a semiconductor memory or a magnetic memory. A non-lit state of a pixel refers to a state in which a light emitting element of the pixel is not emitting light, namely, a state of a pixel to which a "black" image signal is inputted. A lit state of a pixel refers to a state in which a light emitting element of the pixel is emitting light, namely, a state of a pixel to which a "white" image signal is inputted.

According to the present invention, there is provided a method of driving a light emitting device having a display panel, the method characterized by comprising:

measuring a current value $I_0$ of when every pixel in the display panel is not lit;

measuring current values $I_1$, $I_2$, . . . In of when video signals $P_1$, $P_2$, . . . $P_n$ (n is a natural number) are inputted to pixels of the display panel;

calculating an interpolation function F using the $Q_1$, $Q_2$, . . . $Q_n$, which are the differences between the current value $I_0$ and the current value $I_1$, $I_2$, . . . $I_n$, the video signals $P_1$, $P_2$, . . . , $P_n$, and an interpolation expression, Q=F(P); and correcting video signals inputted to pixels of the display panel using the interpolation function F.

A typical structure of the pixel in the present invention includes a first semiconductor element for controlling a current flowing between two electrodes of the light emitting element, a second semiconductor element for controlling input of a video signal to the pixel, and a capacitor element for holding the video signal. The semiconductor elements correspond to transistors or other elements that have a switching function. The capacitor element has a function of holding electric charges and its material is not particularly limited.

The present invention structured as above can provide a light emitting device and its driving method in which the light emitting device is driven by an analog method and influence of fluctuation in characteristic among transistors is removed to obtain clear multi-gray scale display. Furthermore, the present invention can provide a light emitting device and its driving method in which a change with age in amount of current flowing between two electrodes of a light emitting element is reduced to obtain clear multi-gray scale display.

DETAILED DESCRIPTION OF THE PREFERRED EMBODIMENTS

Embodiment Mode

An embodiment mode of the present invention will be described with reference to FIGS. 1 to 5.

Figure 1:
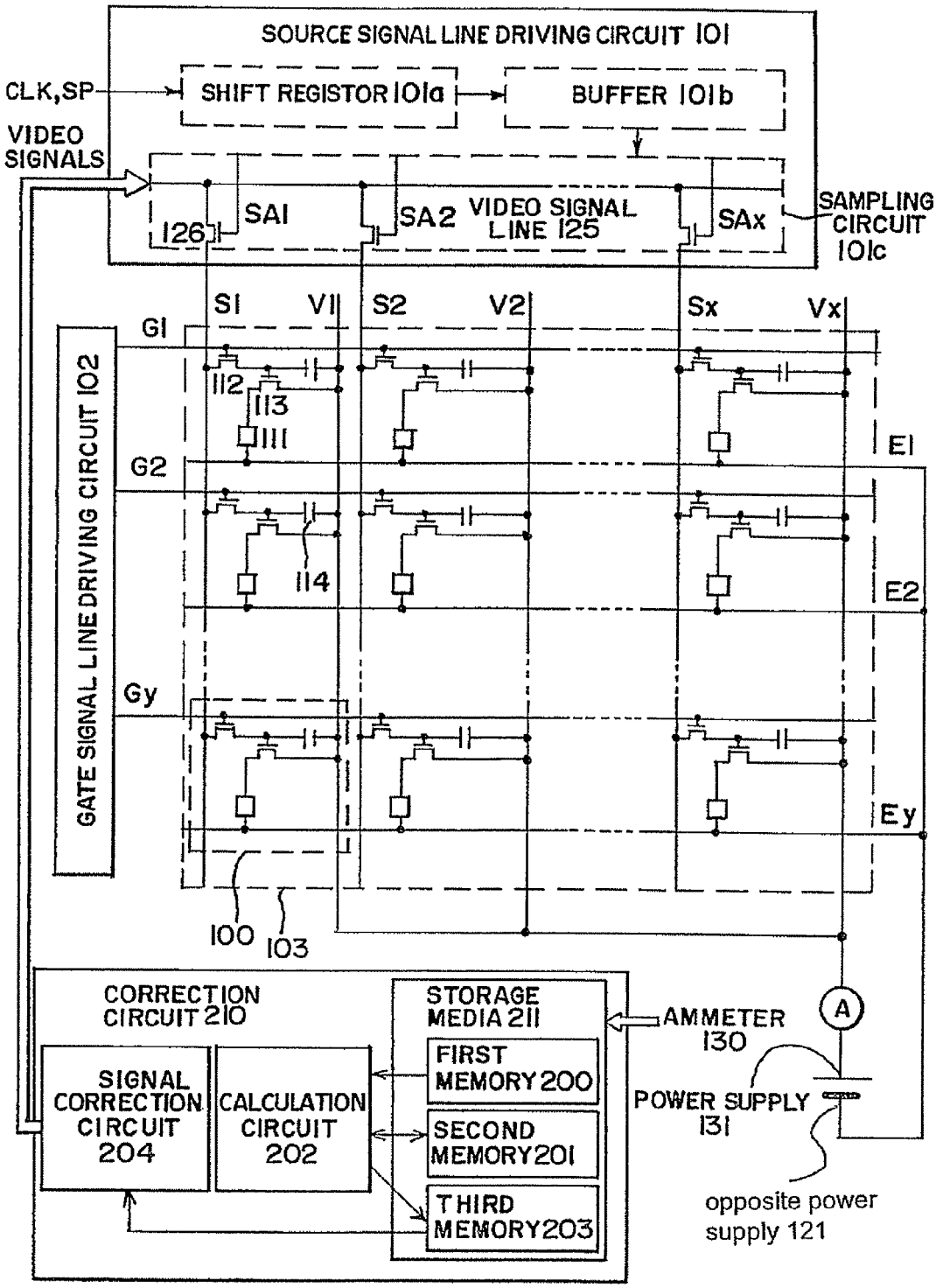
FIG. 1 is a circuit diagram of a light emitting device of the present invention.

FIG. 1 is an example of circuit diagram of a light emitting device. In FIG. 1, the light emitting device has a pixel portion 103, and a source signal line driving circuit 101 and gate signal line driving circuit 102 which are arranged on the periphery of the pixel portion 103. The light emitting device in FIG. 1 has one source signal line driving circuit 101 and one gate signal line driving circuit 102, but the present invention is not limited thereto. Depending on the structure of pixels 100, the number of source signal line driving circuit 101 and the number of gate signal line driving circuit 102 can be set arbitrarily.

The source signal line driving circuit 101 has a shift register 101*a*, a buffer 101*b*, and a sampling circuit 101*c*. However, the present invention is not limited thereto and 101 may have a holding circuit and the like.

Clock signals (CLK) and start pulses (SP) are inputted to the shift register 101*a*. In response to the clock signals (CLK) and start pulses (SP), the shift register 101*a* sequentially generates timing signals, which are sequentially inputted to the sampling circuit 101*c* through the buffer 101*b*.

The timing signals supplied from the shift register 101*a* are buffered and amplified by the buffer 101*b*. Wires to which the timing signals are inputted, are connected to many circuits or elements and therefore have large load capacitance. The buffer 101*b* is provided to avoid dulled rise or fall of timing signals which is caused by the large load capacitance.

The sampling circuit 101*c* sequentially outputs video signals to the pixels 100 in response to the timing signals inputted from the buffer 101*b*. The sampling circuit 101*c* has a video signal line 125 and sampling lines (SA1 to SAx). Note that the present invention is not limited to this structure and 101*c* may have an analog switch or other semiconductor elements.

The pixel portion 103 has source signal lines (S1 to Sx), gate signal lines (G1 to Gy), power supply lines (V1 to Vx), and opposite power supply lines (E1 to Ey). The plural pixels 100 are arranged in the pixel portion 103 so as to form a matrix pattern.

The power supply lines (V1 to Vx) are connected to a power supply 131 through an ammeter 130. The ammeter 130 and the power supply 131 may be formed on a substrate different from the one on which the pixel portion 103 is formed to be connected to the pixel portion 103 through a connector or the like. Alternatively, if possible, 130 and 131 may be formed on the same substrate where the pixel portion 103 is formed. The number of ammeter 130 and the number of power supply 131 are not particularly limited and can be set arbitrarily. It is sufficient if the ammeter 130 is connected to a wire that supplies a current to a light emitting element 111. For instance, the ammeter 130 may be connected to the opposite power supply lines (E1 to Ey). In short, the place of the ammeter 130 is not particularly limited. The ammeter 130 corresponds to the measuring means.

The current value measured by the ammeter 130 is sent as data to a correction circuit 210. The correction circuit 210 has a storage medium (the memory means) 211, a calculation circuit (the calculating means) 202, and a signal correction circuit (the signal correcting means) 204. The structure of the correction circuit 210 is not limited to the one shown in FIGS. 1 and 210 may have an amplifier circuit, a converter circuit, and the like. If necessary, the correction circuit 210 may have the storage medium 211 alone. The structure of the correction circuit 210 can be set arbitrarily.

The storage medium 211 has a first memory 200, a second memory 201, and a third memory 203. However, the present invention is not limited thereto and the number of memories can be set at designer's discretion. A known storage medium such as a ROM, RAM, flash memory, or magnetic tape can be used as the storage medium 211. When the storage medium 211 is integrated with the substrate on which the pixel portion is placed, a semiconductor memory, especially ROM, is preferred as the storage medium 211. If the light emitting device of the present invention is used as a display device of a computer, the storage medium 211 may be provided in the computer.

The calculation circuit 202 has a measure to calculate. More specifically, The calculation circuit 202 has a measure to calculate current values $Q_1, Q_2, \ldots, Q_n$ by subtracting a current value $I_0$ of when the pixel portion 103 does not emit light from the current values $I_1, I_2, \ldots, I_n$. The calculation circuit 202 has a measure to calculate the interpolation function of the above expression (3) from the current values $Q_1, Q_2, \ldots, Q_n$ of when video signals $P_1, P_2, \ldots, P_n$ are inputted to the pixels 100. A known calculation circuit or microcomputer can be used as the calculation circuit 202. If the light emitting device of the present invention is used as a display device of a computer, the calculation circuit 202 may be provided in the computer.

The signal correction circuit 204 has a measure to correct video signals. More specifically, 204 has a measure to correct video signals to be inputted to the pixels 100 using an interpolation function F stored in the storage medium 211 for each of the pixels 100 and the above expression (3). A known signal correction circuit, microcomputer, or the like can be used as the signal correction circuit 204. If the light emitting device of the present invention is used as a display device of a computer, the signal correction circuit 204 may be provided in the computer.

The source signal lines (S1 to Sx) are connected to the video signal line 125 through a sampling transistor 126. The sampling transistor 126 has a source region and a drain region one of which is connected to a source signal line S (one of S1 to Sx) and the other of which is connected to the video signal line 125. A gate electrode of the sampling transistor 126 is connected to a sampling line SA (one of SA1 to SAx).

Figure 2:
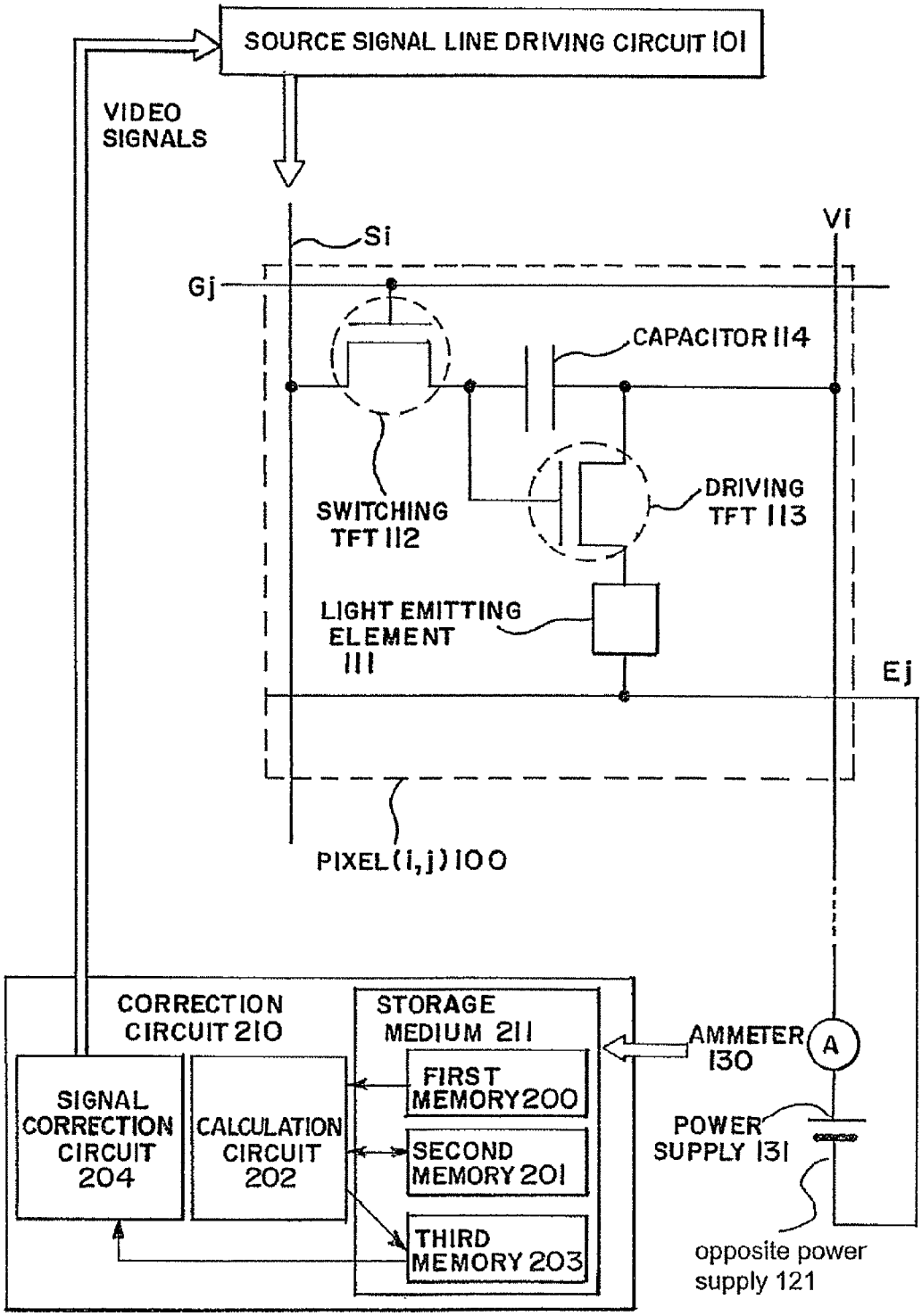
FIG. 2 is a circuit diagram of a light emitting device of the present invention.

An enlarged view of one of the pixels 100, a pixel on row j and column i, is shown in FIG. 2. In this pixel (i, j), 111 denotes a light emitting element, 112, a switching transistor, 113, a driving transistor, and 114, a capacitor.

A gate electrode of the switching transistor 112 is connected to a gate signal line (Gj). The switching transistor 112 has a source region and a drain region one of which is connected to a source signal line (Si) and the other of which is connected to a gate electrode of the driving transistor 113. The switching transistor 112 is a transistor functioning as a switching element when a signal is inputted to the pixel (i, j). The source signal line (Si) to which the switching transistor 112 is connected is connected to the video signal line 125 through the sampling transistor 126 as shown in FIG. 1, but is not shown in FIG. 2.

The capacitor 114 is provided to hold the gate voltage of the driving transistor 113 when the switching transistor 112 is not selected (OFF state). Although this embodiment mode employs the capacitor 114, the present invention is not limited thereto. The capacitor 114 may be omitted.

The source region of the driving transistor 113 is connected to a power supply line (Vi) and a drain region of 113 is connected to the light emitting element 111. The power supply line (Vi) is connected to the power supply 131 through the ammeter 130 and receives a constant power supply electric potential. The power supply line Vi is also connected to the capacitor 114. The driving transistor 113 is a transistor functioning as an element for controlling a current supplied to the light emitting element 111 (current controlling element).

The light emitting element 111 is composed of an anode, a cathode, and an organic compound layer interposed between the anode and the cathode. If the anode is connected to the drain region of the driving transistor 113, the anode serves as a pixel electrode while the cathode serves as an opposite electrode. On the other hand, if the cathode is connected to the drain region of the driving transistor 113, the cathode serves as the pixel electrode whereas the anode serves as the opposite electrode.

A light emitting element is structured such that an organic compound layer is sandwiched between a pair of electrodes (an anode and a cathode). An organic compound layer can be formed from a known light emitting material. There are two types of structures for organic compound layer; a single-layer structure and a multi-layer structure. Either structure can be employed. Luminescence in organic compound layers is classified into light emission upon return to the base state from singlet excitation (fluorescence) and light emission upon return to the base state from triplet excitation (phosphorescence). Either type of light emission can be employed.

The opposite electrode of the light emitting element is connected to the opposite power supply 121. The electric potential of the opposite power supply 121 is called an opposite electric potential. The difference between the electric potential of the pixel electrode and the electric potential of the opposite electrode is the drive voltage, which is applied to the organic compound layer.

Figure 3A:
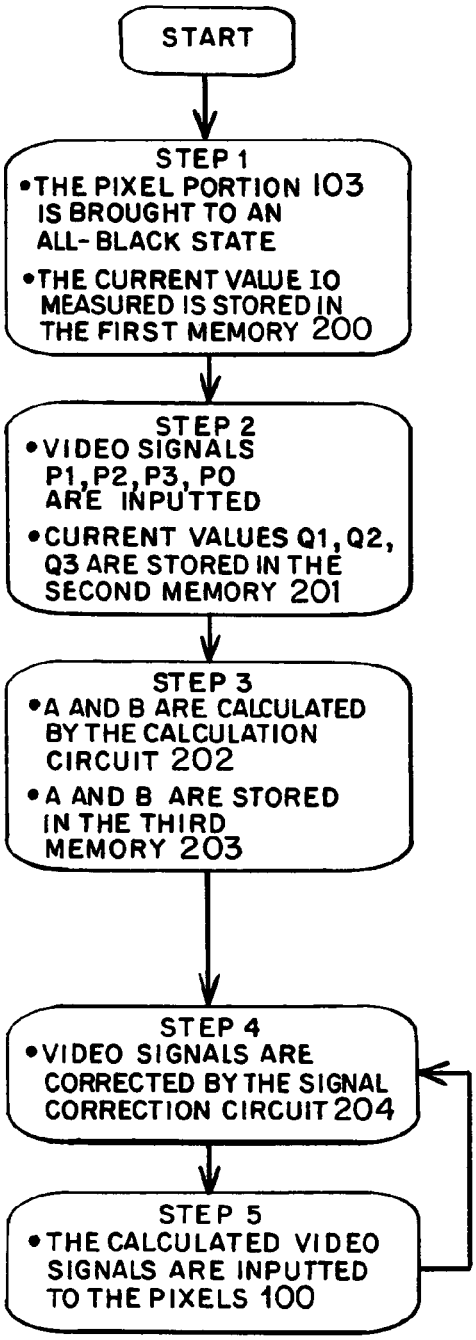
FIGS. 3A and 3B are diagrams illustrating a method of driving a light emitting device according to the present invention.
Figure 3B:
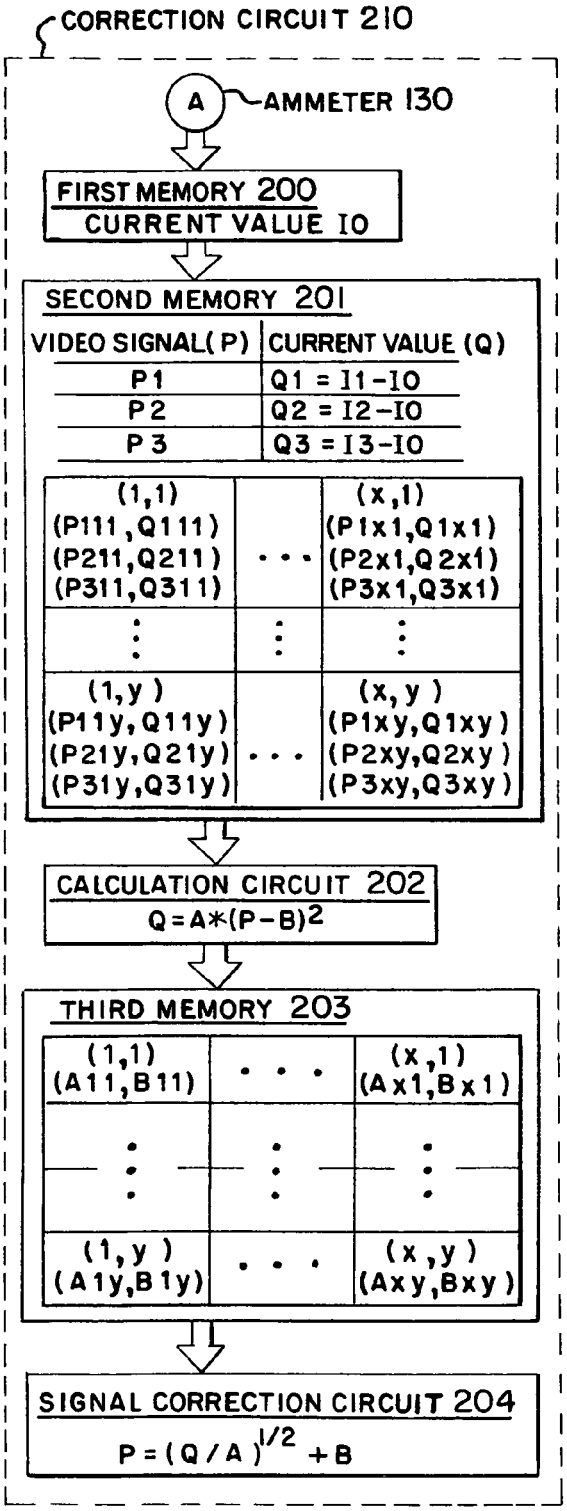

Next, a description is given with reference to FIG. 3A on a method of specifying the characteristic of the driving transistor 113 provided in each of the pixels 100 and correcting a video signal to be inputted to each of the pixels 100 based on the specification in the light emitting device shown in FIGS. 1 and 2 in accordance with the present invention. In order to make the explanation easy to understand, stages of the method are referred to as Step 1 to Step 5. FIG. 3B shows the correction circuit 210 and cross-reference can be made between FIGS. 3A and 3B.

FIGS. 4A to 4D are timing charts of signals outputted from the driving circuits (the source signal line driving circuit 101 and gate signal line driving circuit 102) provided in the light emitting device. Since the pixel portion 103 has y gate signal lines, y line periods (L1 to Ly) are provided in one frame period.

Figures 4A, 4B, 4C, 4D:
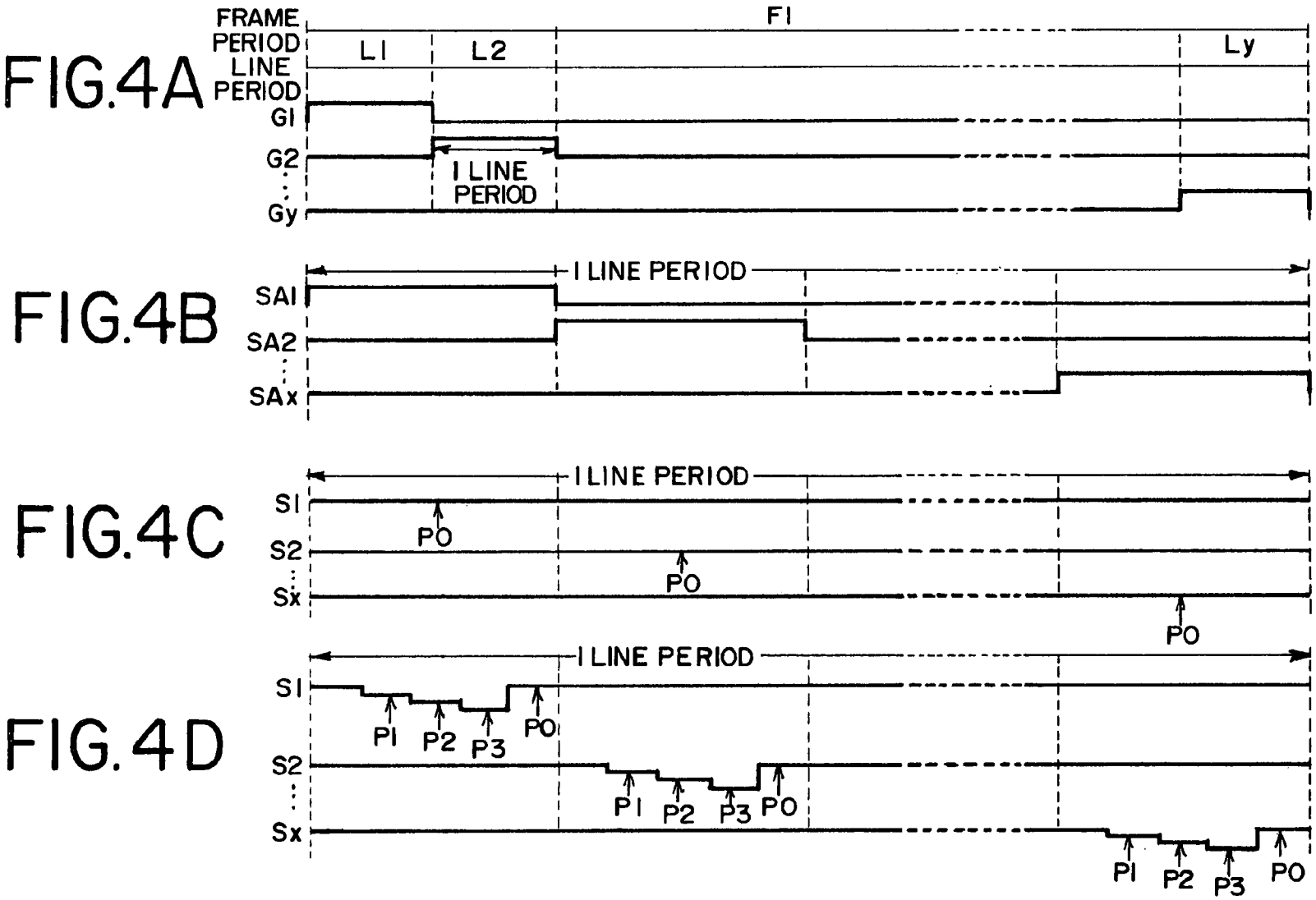
FIGS. 4A to 4D are timing charts of signals inputted to a light emitting device of the present invention.

FIG. 4A shows how one frame period passes after selecting y gate signal lines (G1 to Gy) is completed by repeating selecting one gate signal line G (one of G1 to Gy) in one line period (L). FIG. 4B shows how one line period passes after selecting all of the x sampling lines (SA1 to SAx) is completed by repeating selecting one sampling line SA (one of SA1 to SAx) at a time. FIG. 4C shows how a video signal $P_0$ is inputted to the source signal lines (S1 to Sx) in Step 1. FIG. 4D shows how video signals $P_1$, $P_2$, $P_3$, and $P_0$ are inputted to the source signal lines (S1 to Sx) in Step 2.

First, in Step 1, the pixel portion 103 is brought to an all-black state. The all-black state refers to a state in which every light emitting element 111 stops emitting light, namely, a state in which none of the pixels are lit. FIG. 4C shows how a video signal $P_0$ is inputted to the source signal lines (S1 to Sx) in Step 1. In FIG. 4C, the video signal $P_0$ is inputted to the source signal lines (S1 to Sx) in only one line period. In practice, the video signal $P_0$ is inputted to the source signal lines in all of the line periods (L1 to Ly) provided in one frame period (F). When inputting the same video signal $P_0$ to all the pixels 100 is completed in one frame period, every light emitting element 111 provided in the pixel portion 103 stops emitting light (all-black state).

After this state is reached, a current value $I_0$ of current flowing in the power supply lines (V1 to Vx) is measured using the ammeter 130. The current value $I_0$ measured at this point corresponds to the value of a current that accidentally flows if there is short circuit between the anode and cathode of the light emitting element 111 or short circuit in some of the pixels 100, or if an FPC is not connected to the pixel portion 103 securely. The current value $I_0$ measured is stored in the first memory 200 provided in the correction circuit 210, thereby ending Step 1.

Next, in Step 2, different video signals $P_1$, $P_2$, $P_3$, and $P_0$ are inputted to the pixels 100 provided in the pixel portion 103.

In this embodiment mode, four video signals $P_1$, $P_2$, $P_3$, and $P_0$ that are shifted from one another in step-wise are inputted to the source signal lines (S1 to Sx) as shown in FIG. 4D. To put it into words, four video signals $P_1$, $P_2$, $P_3$, and $P_0$ are inputted to one of the pixels 100 in one line period (L) and, by repeating this, the four video signals $P_1$, $P_2$, $P_3$, and $P_0$ are inputted to all of the pixels 100 in the pixel portion 103 in one frame period (F).

Then values of current flowing into the driving transistor 113, namely, the power supply lines (V1 to Vx), in response to three video signals $P_1$, $P_2$, and $P_3$ are measured by the ammeter 130.

Although four video signals $P_1$, $P_2$, $P_3$, and $P_0$ that are shifted from one another in step-wise are inputted to one pixel in one line period (L) in this embodiment mode, the present invention is not limited thereto. For instance, only a video signal $P_1$ may be inputted in one line period (L) to input a video signal $P_2$ in the next line period (L) and to input a video signal $P_3$ to a line period that follows the next period. Four video signals $P_1$, $P_2$, $P_3$, and $P_0$ inputted in this embodiment mode are shifted from one another in step-wise. However, it is sufficient in the present invention if video signals having different voltage values are inputted to measure current values that are associated with the video signals of different voltage values. For instance, video signals shifted from one another in a ramp-like manner (like saw-teeth) may be inputted to measure plural current values at regular intervals using the ammeter 130.

Now, a case in which a gate signal line (Gj) on the j-th row is selected by a gate signal supplied from the gate signal line driving circuit 102 is described as an example. In a line period (Lj), four video signals $P_1$, $P_2$, $P_3$, and $P_0$ are inputted to a pixel (1, j) and therefore pixels other than the pixel (1, j) are all turned OFF. Accordingly, the current value measured by the ammeter 130 is the sum of the value of current flowing in the driving transistor 113 of the specified pixel (1, j) and the current value $I_0$ measured in Step 1. Then current values $I_1$, $I_2$, and $I_3$ respectively associated with $P_1$, $P_2$, and $P_3$ are measured in the pixel (1, j) and the measured current values $I_1$, $I_2$, and $I_3$ are stored in the second memory 201.

Next, a video signal $P_0$ is inputted to the pixel (1, j) to make the light emitting element 111 of the pixel (1, j) stop emitting light so that the pixel (1, j) is no longer lit. This is to prevent a current from flowing during measurement of the next pixel (2, j).

The four video signals $P_1$, $P_2$, $P_3$, and $P_0$ are then inputted to the pixel (2, j). Current values $I_1$, $I_2$, and $I_3$ respectively associated with the video signals $P_1$, $P_2$, and $P_3$ are obtained and stored in the second memory 201.

In this way the above operation is repeated until inputting the video signals to the pixels on row j and columns 1 through x is completed. In other words, the one line period Lj is ended as inputting the video signals to all the source signal lines (S1 to Sx) is finished.

Then the next line period $L_{j+1}$ is started and a gate signal line $G_{j+1}$ is selected by a gate signal supplied from the gate signal line driving circuit 102. Then four video signals $P_1$, $P_2$, $P_3$, and $P_0$ are inputted to every one of the source signal lines (S1 to Sx).

The operation described above is repeated until inputting gate signals to all the gate signal lines (G1 to Gy) is finished. This completes all the line periods (L1 to Ly). As all the line periods (L1 to Ly) are completed, one frame period is ended.

In this way, current values $I_1$, $I_2$, and $I_3$ respectively associated with the three video signals $P_1$, $P_2$, and $P_3$ inputted to the pixels 100 in the pixel portion 103 are measured. The obtained data are stored in the second memory 201.

From the current values $I_1$, $I_2$, and $I_3$ measured for each of the pixels 100 in the pixel portion 103, the calculation circuit 202 calculates the difference between them and the current value $I_0$ that is stored in the first memory 200 in Step 1. Thus obtained are current values $Q_1$, $Q_2$, and $Q_3$ of currents. Thus, the following expressions are obtained.

$$Q1=I_1-I_0$$

$$Q_2=I_2-I_0$$

$$Q_3=I_3-I_0$$

The current values $Q_1$, $Q_2$, and $Q_3$ are stored in the second memory 201 to end Step 2.

If the pixel portion 103 has no pixel that short-circuits and if the FPC is securely connected to the pixel portion 103, the current value $I_0$ measured is 0 or almost 0. In this case, the operation of subtracting the current value $I_0$ from the current values $I_1$, $I_2$, and $I_3$ for each of the pixels 100 in the pixel portion 103 and the operation of measuring the current value $I_0$ can be omitted. These operations may be optional.

In Step 3, the calculation circuit 202 calculates the current-voltage characteristic ($I_{DS}$-$V_{GS}$ characteristic) of the driving transistor for each pixel using the above expression (1). If $I_{DS}$, $V_{GS}$, and $V_{TH}$ are I, P, and B, respectively, in the expression (1) and $Q=I-I_0$, the following expression (4) is obtained.

[Mathematical Expression 4]

$$Q=A*(P-B)^2 \tag{4}$$

In the expression (4), A and B are each constant. The constant A and the constant B can be obtained when at least two sets of data for (P, Q) are known. To elaborate, the constant A and the constant B can be obtained by substituting the variables in the expression (3) with at least two video signals (P) of different voltage values which have been obtained in Step 2 and at least two current values (Q) associated with the video signals (P). The constant A and the constant B are stored in the third memory 203.

The voltage value of a video signal (P) necessary to cause a current having a certain current value (Q) to flow can be obtained from the constant A and constant B stored in the third memory 203. The calculation uses the following expression (5).

$$\begin{aligned} P &= (Q/A)^{1/2} + B \\ &= \{(I-I_0)/A\}^{1/2} + B \end{aligned} \tag{5}$$

Figure 5:
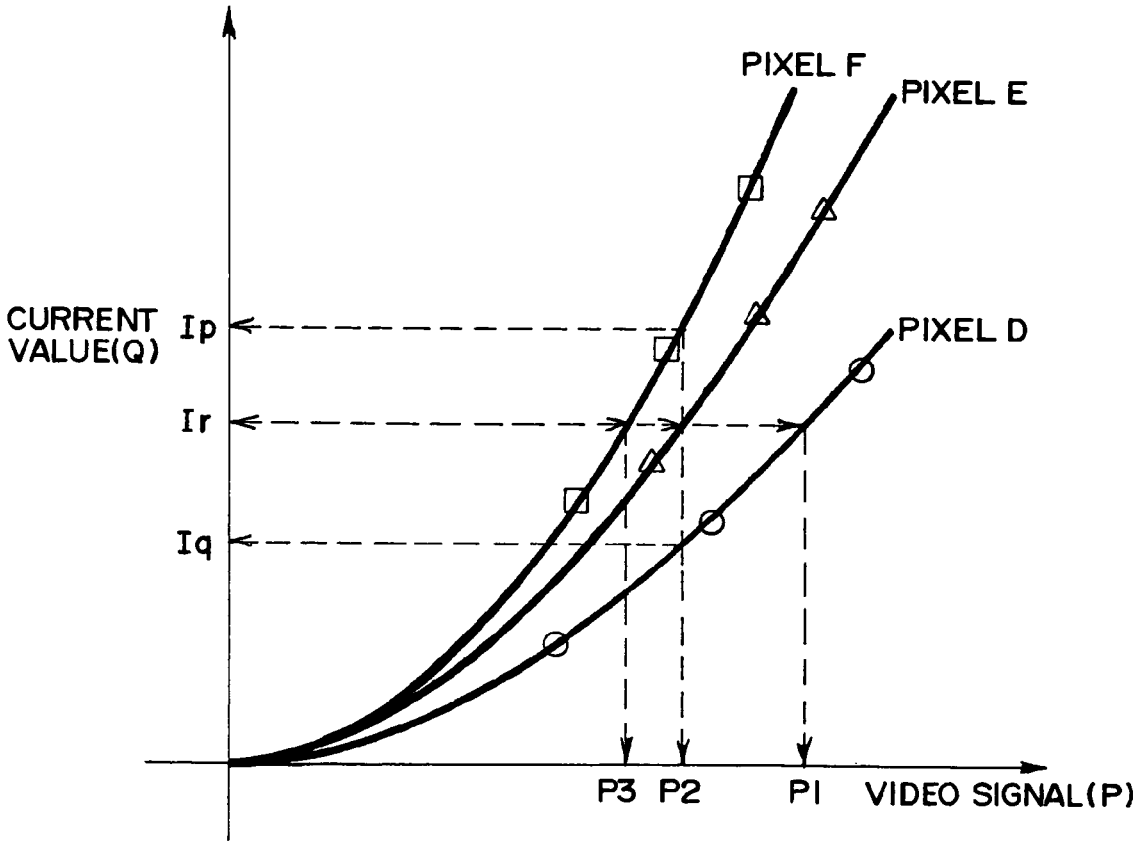
FIG. 5 is a diagram showing the relation between video signal and the current value.

An example is given here and the constant A and constant B of pixels D, E, and F are calculated using the expressions (4) and (5). The results are graphed in FIG. 5. As shown in FIG. 5, when the same video signal (here, a video signal $P_2$ as an example) is inputted to the pixels D, E, and F, a current indicated by Iq flows in the pixel D, a current indicated by Ir flows in the pixel E, and a current indicated by Ip flows in the pixel F. The current value varies among the pixels D, E, and F even though the same video signal ($P_2$) is inputted because the transistors provided in the pixels D, E, and F have characteristics different from one another. The present invention removes such influence of fluctuation in characteristic by inputting video signals suited to characteristics of the respective pixels 100 using the above expression (4).

Figure 16:
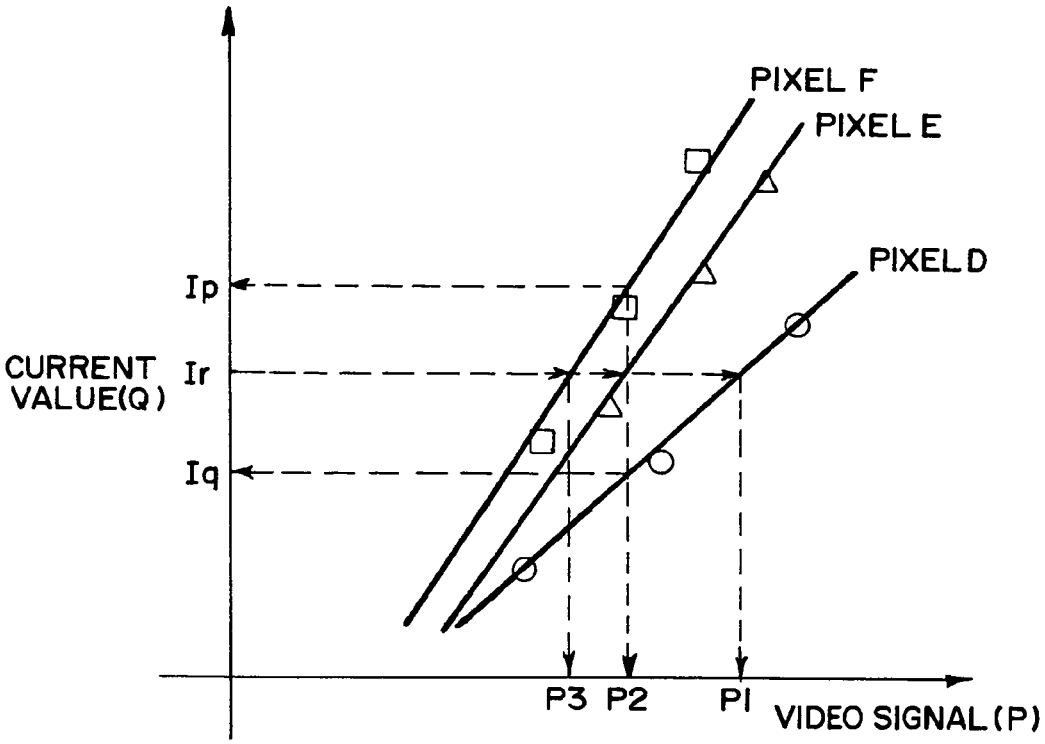
FIG. 16 is a diagram showing the relation between video signal and current value.

Although the characteristics of the pixels D, E, and F are expressed in quadric curve using the expressions (4) and (5) in FIG. 5, the present invention is not limited thereto. FIG. 16 shows a graph in which the relation between video signals (P) inputted to the pixels D, E, and F and current values (Q) associated with the video signals (P) is expressed in straight line using the following expression (6).

[Mathematical Expression 6]

$$Q=a*P+B \quad (6)$$

By substituting the variables in the expression (6) with the voltage value (P) and current value (Q) obtained for each pixel in Step 2, a constant a and a constant b are calculated. The constant a and constant b obtained are stored in the third memory 203 for each of the pixels 100, thereby ending Step 3.

In the graph of FIG. 16, similar to the graph shown in FIG. 5, a current indicated by Iq flows in the pixel D, a current indicated by Ir flows in the pixel E, and a current indicated by Ip flows in the pixel F when the same video signal (here, a video signal $P_2$ as an example) is inputted to the pixels D, E, and F. The current value varies among the pixels D, E, and F even though the same video signal ($P_2$) is inputted because the transistors provided in the pixels D, E, and F have characteristics different from one another. The present invention removes such influence of fluctuation in characteristic by inputting video signals suited to characteristics of the respective pixels 100 using the above expression (6).

For a method to specify the relation between the video signal voltage value (P) and the current value (Q), a quadric curve may be used as shown in FIG. 5 or a straight line may be used as shown in FIG. 16. A spline curve or a Bezier curve may also be used for the specifying method. If the current value is not expressed in curve well, the curve may be optimized by the least-squares method. The specifying method is not particularly limited.

Next, in Step 4, the signal correction circuit 204 calculates video signal voltage values suited to characteristics of the respective pixels 100 using the above expression (5), (6) or the like. Then Step 4 is ended to move on to Step 5 in which the calculated video signals are inputted to the pixels 100. This makes it possible to remove influence of fluctuation in characteristic among driving transistors and to cause a desired amount of current to flow into the light emitting element. As a result, a desired amount of light emission (luminance) can be obtained. Once the constants calculated for each of the pixels 100 are stored in the third memory 203, just repeat Step 4 and Step 5 alternately.

Again reference is made to FIG. 5. If the pixels D, E, and F are to emit light at the same luminance, the pixels have to receive the same current value Ir. To make the same amount of current to flow in the pixels, video signals suited to characteristics of their driving transistors have to be inputted to the pixels, and a video signal P, has to be inputted to the pixel D, a video signal $P_2$ to the pixel E, and a video signal $P_3$ to the pixel F as shown in FIG. 5. Therefore it is indispensable to obtain video signals suited to characteristics of the respective pixels in Step 4 and to input the obtained signals to the respective pixels.

The operation of measuring plural current values associated with plural different video signals using the ammeter 130 (the operation of Step 1 to Step 3) may be carried out immediately before or after an image is actually displayed, or may be carried out at regular intervals. Alternatively, the operation may be conducted before a given information is stored in the memory means. It is also possible to conduct the operation only once before shipping. In this case, the interpolation function F calculated in the calculation circuit 202 is stored in the storage medium 211 and then the storage medium 211 is integrated with the pixel portion 103. In this way, a video signal suited to the characteristic of each pixel can be calculated by consulting the interpolation function F stored in the storage medium 211 and therefore the light emitting device does not need to have the ammeter 130.

In this embodiment mode, once the interpolation function F is stored in the storage medium 211, video signals to be inputted to the pixels 100 are calculated by the calculation circuit 202 based on the interpolation function F as the need arises, and then the video signals calculated are inputted to the pixels 100. However, the present invention is not limited thereto.

For instance, a number of video signals corresponding to the gray scale number of an image to be displayed may be calculated for each of the pixels 100 in advance by the calculation circuit 202 based on the interpolation function F stored in the storage medium 211 to store the calculated video signals in the storage medium 211. If an image is to be displayed in, e.g., 16 gray scales, 16 video signals corresponding to the 16 gray scales are calculated for each of the pixels 100 in advance and the calculated video signals are stored in the storage medium 211. This way information of video signals to be inputted when a given gray scale is to be obtained is stored in the storage medium 211 for each of the pixels 100, making it possible to display the image based on the information. In short, an image can be displayed without providing the calculation circuit 202 in the light emitting device by using information stored in the storage medium 211.

In the case where a number of video signals corresponding to the gray scale number of an image to be displayed is calculated for each of the pixels 100 in advance by the calculation circuit 202, the storage medium 211 may store video signals obtained by performing γ correction with γ value on the calculated video signals. The γ value used may be common throughout the pixel portion, or may vary among pixels. This makes it possible to display a clearer image.

Embodiment 1

The present invention is also applicable to a light emitting device with a pixel having a structure different from the one in FIG. 2. This embodiment describes an example thereof with reference to FIG. 6 and FIGS. 18B and 18C.

Figure 6:
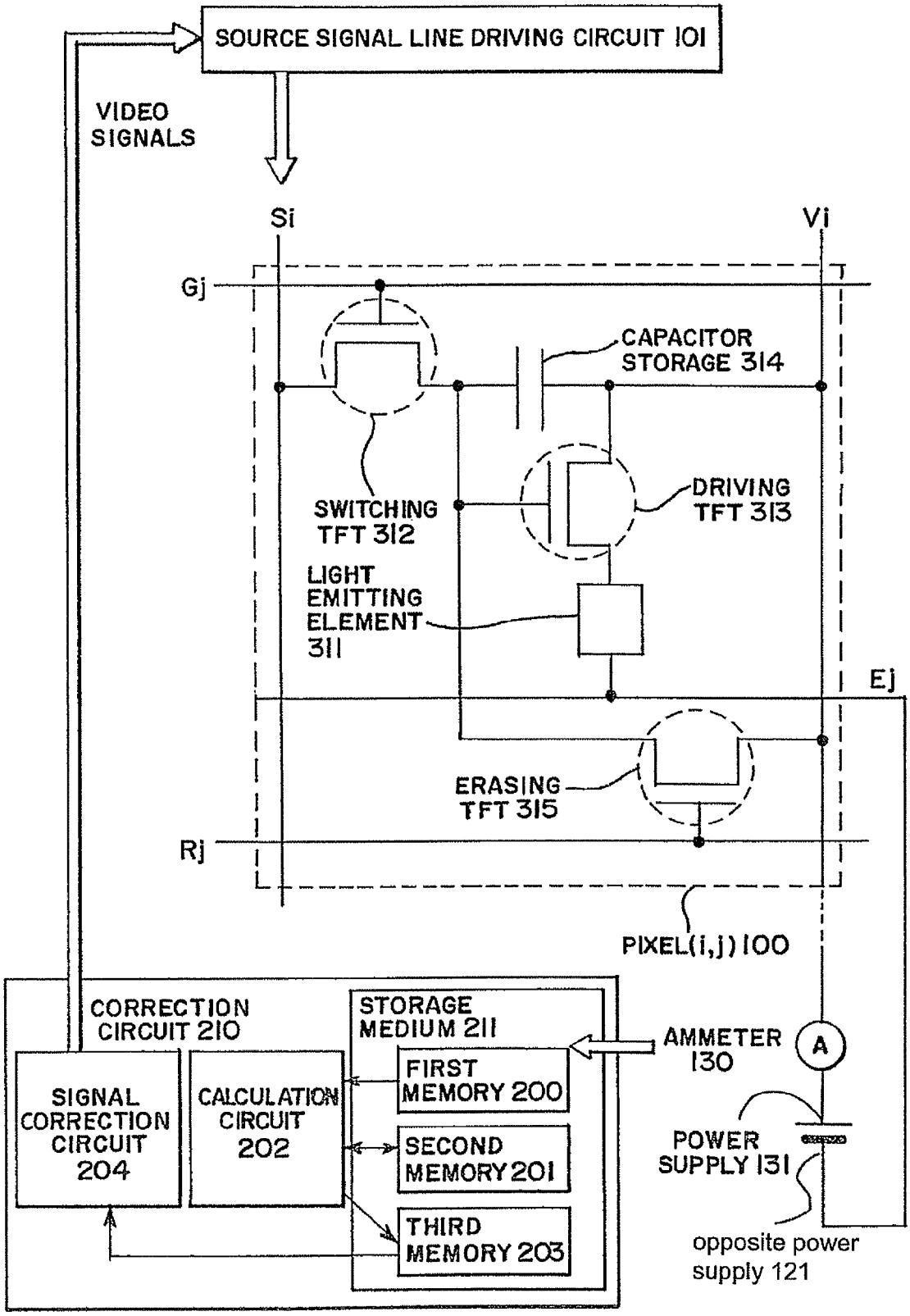
FIG. 6 is a circuit diagram of a pixel in a light emitting device of the present invention.

A pixel (i, j) shown in FIG. 6 has a light emitting element 311, a switching transistor 312, a driving transistor 313, an erasing transistor 315, and a capacitor storage 314. The pixel (i, j) is placed in a region surrounded by a source signal line (Si), a power supply line (Vi), a gate signal line (Gj), and an erasing gate signal line (Rj).

A gate electrode of the switching transistor 312 is connected to a gate signal line (Gj). The switching transistor 312 has a source region and a drain region one of which is connected to a source signal line (Si) and the other of which is connected to a gate electrode of the driving transistor 313. The switching transistor 312 is a transistor functioning as a switching element when a signal is inputted to the pixel (i, j).

The capacitor 314 is provided to hold the gate voltage of the driving transistor 313 when the switching transistor 312 is not selected (OFF state). Although this embodiment mode employs the capacitor 314, the present invention is not limited thereto. The capacitor 314 may be omitted.

The source region of the driving transistor 313 is connected to a power supply line (Vi) and a drain region of 313 is connected to the light emitting element 311. The power supply line (Vi) is connected to the power supply 131 through the ammeter 130 and receives a constant power supply electric potential. The power supply line (Vi) is also connected to the capacitor 314. The driving transistor 313 is a transistor functioning as an element for controlling a current supplied to the light emitting element 311 (current controlling element).

The light emitting element 311 is composed of an anode, a cathode, and an organic compound layer interposed between the anode and the cathode. If the anode is connected to the drain region of the driving transistor 313, the anode serves as a pixel electrode while the cathode serves as an opposite electrode. On the other hand, if the cathode is connected to the drain region of the driving transistor 313, the cathode serves as the pixel electrode whereas the anode serves as the opposite electrode.

A gate electrode of the erasing transistor 315 is connected to the erasing gate signal line (Rj). The erasing transistor 315 has a source region and a drain region one of which is connected to the power supply line (Vi) and the other of which is connected to the gate electrode of the driving transistor 313. The erasing transistor 315 is a transistor functioning as an element for erasing (resetting) a signal written in the pixel (i, j).

When the erasing transistor 315 is turned ON, capacitance held in the capacitor 314 is discharged. This erases (resets) a signal that has been written in the pixel (i, j) to cause the light emitting element to stop emitting light. In short, the pixel (i, j) is forced to stop emitting light by turning the erasing transistor 315 ON. With the erasing transistor 315 provided to force the pixel (i, j) to stop emitting light, various kinds of effects are obtained. For example, in a digital driving method, the length of period in which a light emitting element emits light can be set arbitrarily and therefore a high gray scale image can be displayed. In the case of an analog driving method, it is possible to make a pixel stop emitting light each time a new frame period is started and therefore animation can be displayed clearly without afterimage.

The power supply line (Vi) is connected to the power supply 131 through the ammeter 130. The ammeter 130 and the power supply 131 may be formed on a substrate different from the one on which the pixel portion 103 is formed to be connected to the pixel portion 103 through a connector or the like. Alternatively, if possible, 130 and 131 may be formed on the same substrate where the pixel portion 103 is formed. The number of ammeter 130 and the number of power supply 131 are not particularly limited and can be set arbitrarily.

The current value measured by the ammeter 130 is sent as data to a correction circuit 210. The correction circuit 210 has a storage medium 211, a calculation circuit 202, and a signal correction circuit 204. The structure of the correction circuit 210 is not limited to the one shown in FIGS. 6 and 210 may have an amplifier circuit and the like. The structure of the correction circuit 210 can be set at designer's discretion.

In the pixel portion (not shown in the drawing), pixels identical to the pixel (i, j) shown in FIG. 6 are arranged so as to form a matrix pattern. The pixel portion has source signal lines (S1 to Sx), gate signal lines (G1 to Gy), power supply lines (V1 to Vx), and erasing gate signal lines (R1 to Ry).

Figure 18A:
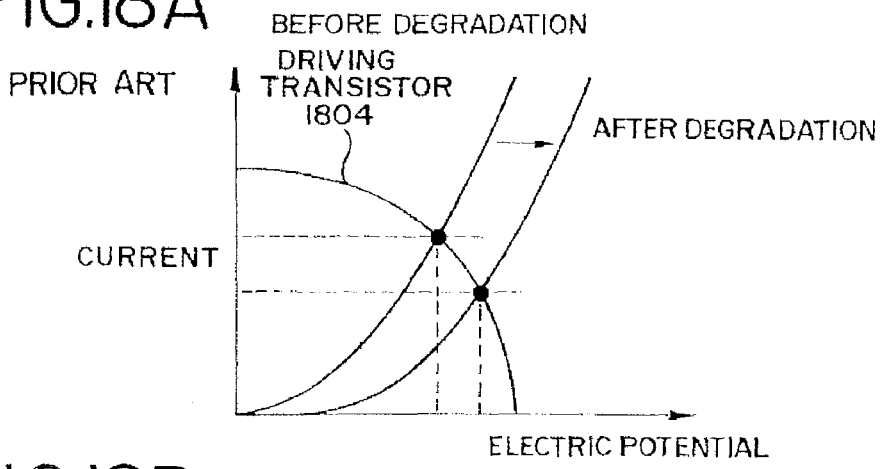
FIGS. 18A to 18C are a diagram showing voltage-current characteristics of a light emitting element and driving transistor and circuit diagrams of pixels.
Figure 18B:
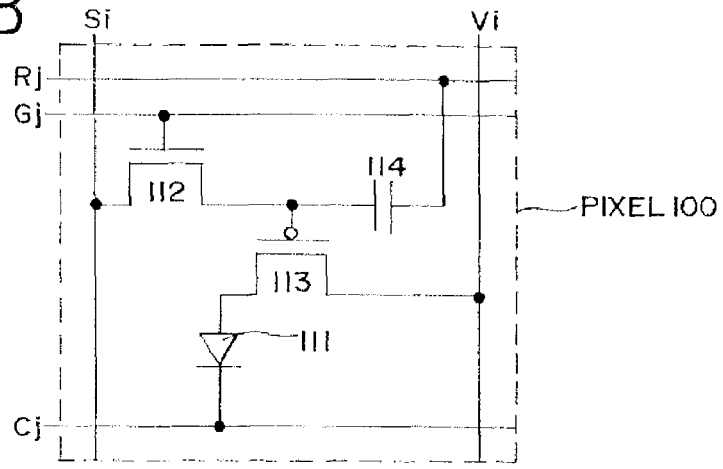
Figure 18C:
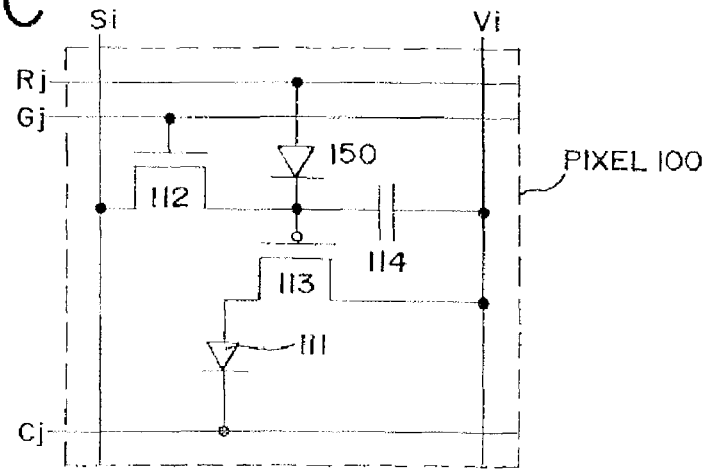

FIG. 18B shows the structure of a pixel obtained by adding a reset line Rj to the pixel shown in FIG. 2. In FIG. 18B, the capacitor 114 is connected to the reset line Rj instead of the power supply line Vi. The capacitor 114 in this case resets the pixel (i, j). FIG. 18C shows the structure of a pixel obtained by adding a reset line Rj and a diode 150 to the pixel shown in FIG. 2. The diode resets the pixel (i, j).

The structure of a pixel of a light emitting device to which the present invention is applied is one that has a light emitting element and a transistor. How the light emitting element and the transistor are connected to each other in the pixel is not particularly limited, and the structure of the pixel shown in this embodiment is an example thereof.

The pixel operation will be described briefly taking as an example the pixel shown in FIG. 6. A digital driving method and an analog driving method are both applicable to the pixel. Here, the operation of the pixel when a digital method combined with a time gray scale method is applied is described. A time gray scale is a method of obtaining gray scale display by controlling the length of period in which a light emitting element emits light as reported in detail in JP 2001-343933 A. Specifically, one frame period is divided into plural sub-frame periods different in length from one another and whether a light emitting element emits light or not is determined for each sub-frame period, so that the gray scale is expressed as the difference in length of light emission periods within one frame period. In short, the gray scale is obtained by controlling the length of light emission period by a video signal.

The present invention removes influence of fluctuation in characteristic among pixels by correcting video signals to be inputted to the respective pixels. Correction of a video signal corresponds to correction of the amplitude of the video signal in a light emitting device that employs an analog method. In a light emitting device that employs a digital method combined with a time gray scale method, correction of a video signal corresponds to correction of the length of light emission period of a pixel to which the video signal is inputted.

It is preferable to use the expression (6) expressed in straight line in a light emitting device to which a digital method combined with a time gray scale method is applied. However, the digital method does not need to measure when light is not emitted, and therefore the constant b in the expression (6) is set to 0. The constant a is obtained by measuring characteristics of the respective pixels only once.

The present invention having the above structure can provide a light emitting device and its driving method in which the light emitting device is driven by an analog method and influence of fluctuation in characteristics among transistors is removed to obtain clear multi-gray scale display. Furthermore, the present invention can provide a light emitting device and its driving method in which a change with age in amount of current flowing between two electrodes of a light emitting element is reduced to obtain clear multi-gray scale display.

This embodiment may be combined freely with Embodiment Mode.

Embodiment 2

Figure 7:
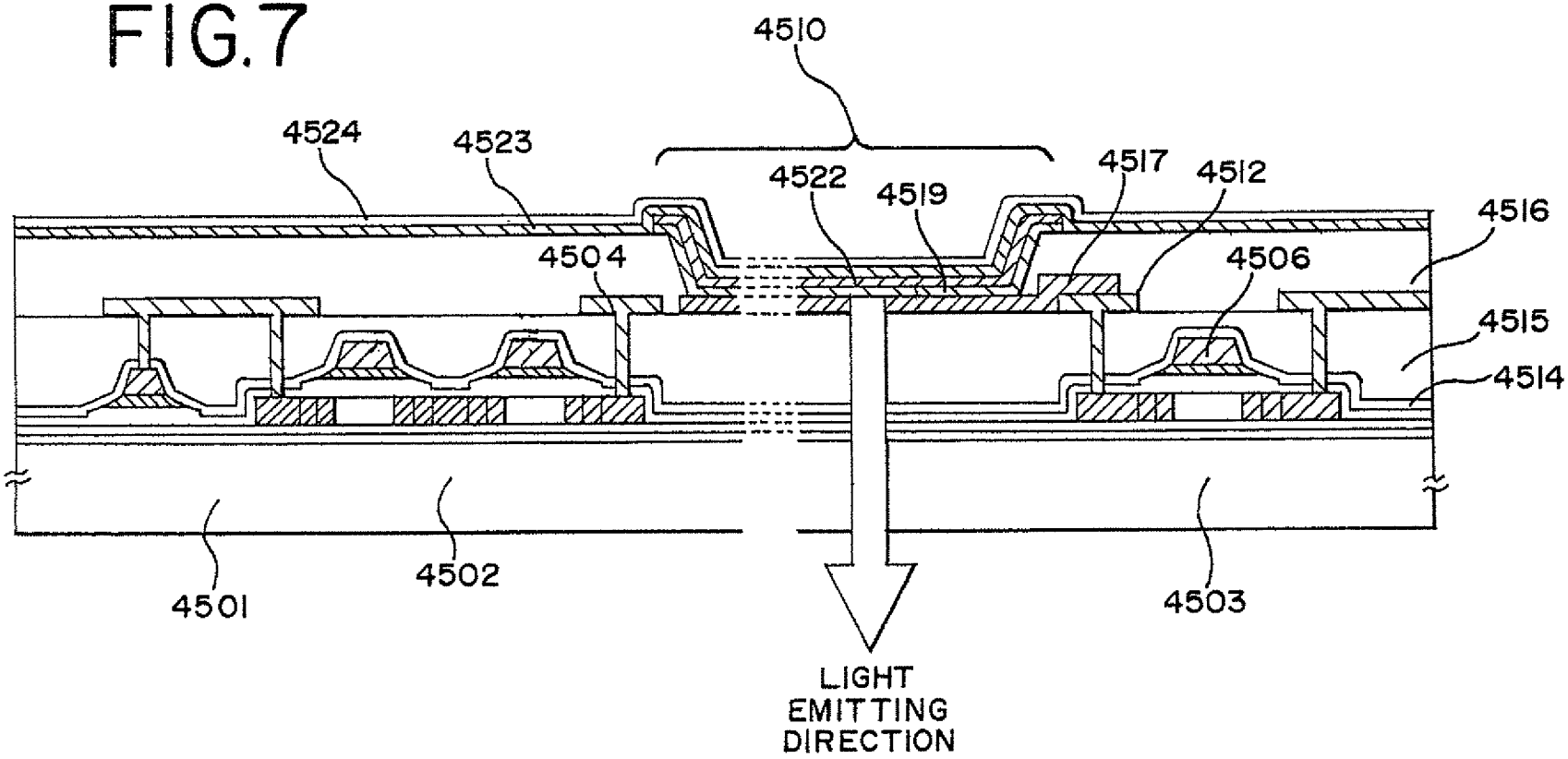
FIG. 7 is a diagram showing a sectional structure (downward emission) of a light emitting device of the present invention.

This embodiment describes an example of sectional structure of a pixel with reference to FIG. 7.

In FIG. 7, a switching transistor 4502, which is an n-channel transistor formed by a known method, is provided on a substrate 4501. The transistor in this embodiment has a double gate structure. However, a single gate structure, a triple gate structure, or a multi-gate structure having more than three gates may be employed instead. The switching transistor 4502 may be a p-channel transistor formed by a known method.

A driving transistor 4503 is an n-channel transistor formed by a known method. A drain wire 4504 of the switching transistor 4502 is electrically connected to a gate electrode 4506 of the driving transistor 4503 through a wire (not shown in the drawing).

The driving transistor 4503 is an element for controlling the amount of current flowing in a light emitting element 4510, and a large amount of current flows through the driving transistor to raise the risk of its degradation by heat or by hot carriers. It is therefore very effective to provide an LDD region in a drain region of the driving transistor 4503, or in each of the drain region and its source region, so as to overlap a gate electrode with a gate insulating film sandwiched therebetween. FIG. 7 shows as an example a case in which an LDD region is formed in the source region and drain region of the driving transistor 4503 each.

The driving transistor 4503 in this embodiment has a single gate structure but a multi-gate structure may be employed instead in which a plurality of transistors are connected in series. Another structure may be employed in which a plurality of transistors are connected in parallel and substantially divide a channel formation region into plural regions to release heat with high efficiency. This structure is effective as a countermeasure against degradation by heat.

A wire (not shown in the drawing) that includes a gate electrode 4506 of the driving transistor 4503 partially overlaps a drain wire 4512 of the driving transistor 4503 with an insulating film sandwiched therebetween. A capacitor storage is formed in this overlapping region. The capacitor storage has a function of holding the voltage applied to the gate electrode 4506 of the driving transistor 4503.

A first interlayer insulating film 4514 is formed on the switching transistor 4502 and the driving transistor 4503. On the first interlayer insulating film, a second interlayer insulating film 4515 is formed from a resin insulating film.

Denoted by 4517 is a pixel electrode (an anode of the light emitting element) formed from a highly transparent conductive film. The pixel electrode is formed so as to partially cover the drain region of the driving transistor 4503 and is electrically connected thereto. The pixel electrode 4517 can be formed of a compound of indium oxide and tin oxide (called ITO) or a compound of indium oxide and zinc oxide. Other transparent conductive films may be used to form the pixel electrode 4517, of course.

Next, an organic resin film 4516 is formed on the pixel electrode 4517, and a part of the film that faces the pixel electrode 4517 is patterned to form an organic compound layer 4519. Though not shown in FIG. 7, an R organic compound layer 4519 for emitting red light, a G organic compound layer 4519 for emitting green light, and a B organic compound layer 4519 for emitting blue light may be formed separately. A light emitting material of the organic compound layer 4519 is a conjugate polymer-based material. Typical examples of polymer-based material include a polyparaphenylene vinylene (PPV)-based material, a polyvinyl carbazole (PVK)-based material, and a polyfluolene-based material. The organic compound layer 4519 can take either a single-layer structure or a multi-layer structure in the present invention. Known materials and structure can be combined freely to form the organic compound layer 4519 (a layer for emitting light, moving carriers and injecting carriers).

For instance, although this embodiment shows an example in which a polymer-based material is used for the organic compound layer 4519, a low molecular weight organic light emitting material may be employed instead. It is also possible to use silicon carbide or other inorganic materials for an electric charge transporting layer and an electric charge injection layer. These organic light emitting material and inorganic material can be known materials.

When a cathode 4523 is formed, the light emitting element 4510 is completed. The light emitting element 4510 here refers to a laminate composed of the pixel electrode 4517, the organic compound layer 4519, a hole injection layer 4522, and the cathode 4523.

In this embodiment, a passivation film 4524 is formed on the cathode 4523. A silicon nitride film or a silicon oxynitride film is preferred as the passivation film 4524. This is to cut the light emitting element 4510 off of the outside and is intended both to prevent degradation due to oxidization of the light emitting material and to reduce gas leakage from the organic light emitting material. The reliability of the light emitting device is thus enhanced.

The light emitting device described as above in this embodiment has a pixel portion with a pixel structured as shown in FIG. 7, and has a selecting transistor that is sufficiently low in OFF current value and a driving transistor that can withstand hot carrier injection. Therefore a light emitting device highly reliable as well as capable of excellent image display can be obtained.

In a light emitting device that has the structure described in this embodiment, light generated in the organic compound layer 4519 is emitted toward the direction of the substrate 4501 on which the transistors are formed as indicated by the arrow. Emission of light from the light emitting element 4510 toward the direction of the substrate 4501 is called downward emission.

Figure 17A:
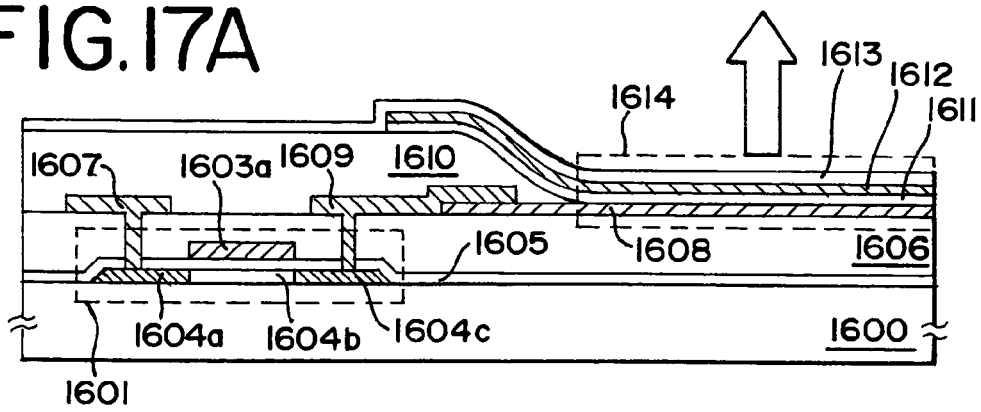
FIGS. 17A and 17B are diagrams showing sectional structures (upward emission) of light emitting devices of the present invention.
Figure 17B:
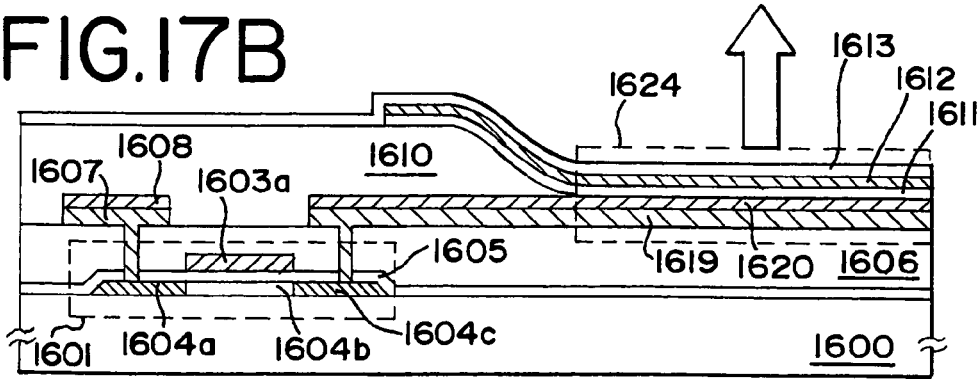

Next, a description is given with reference to FIGS. 17A and 17B on sectional structures of light emitting devices in which light is emitted from a light emitting element toward the direction opposite to the substrate (upward emission).

In FIG. 17A, a driving transistor 1601 is formed on a substrate 1600. The driving transistor 1601 has a source region 1604*a*, a drain region 1604*c*, and a channel formation region 1604*b*. The driving transistor also has a gate electrode 1603*a* above the channel formation region 1604*b* with a gate insulating film 1605 interposed therebetween. A known structure can be freely employed for the driving transistor 1601 without being limited to the structure shown in FIG. 17A.

An interlayer film 1606 is formed on the driving transistor 1601. Next, an ITO film or other transparent conductive film is formed and patterned into a desired shape to obtain a pixel electrode 1608. The pixel electrode 1608 functions here as an anode of a light emitting element 1614.

Contact holes reaching the source region 1604*a* and drain region 1604*c* of the driving transistor 1601 are formed in the interlayer film 1606. Then a laminate consisting of a Ti layer, an Al layer containing Ti, and another Ti layer is formed and patterned into a desired shape. Thus obtained are wires 1607 and 1609.

Subsequently, an insulating film is formed of an acrylic or other organic resin materials. An opening is formed in the insulating film at a position that coincides with the position of the pixel electrode 1608 of the light emitting element 1614 to obtain an insulating film 1610. The opening has to have side walls tapered gently enough to avoid degradation, disconnection, and the like of the organic compound layer due to a level difference in the side walls of the opening.

An organic compound layer 1611 is formed and then an opposite electrode (cathode) 1612 of the light emitting element 1614 is formed from a laminate. The laminate has a cesium (Cs) film with a thickness of 2 nm or less and a silver (Ag) film layered thereon to a thickness of 10 nm or less. By forming the opposite electrode 1612 of the light emitting element 1614 very thin, light emitted from the organic compound layer 1611 transmits through the opposite electrode 1612 and exits in the direction opposite to the substrate 1600. A protective film 1613 is formed in order to protect the light emitting element 1614.

FIG. 17B is a sectional view of a structure different from the one in FIG. 17A. In FIG. 17B, components identical with those of FIG. 17A are denoted by the same reference symbols. Steps up through forming the driving transistor 1601 and the interlayer film 1606 for the structure of FIG. 17B are the same as those for the structure of FIG. 17A, and therefore the explanation thereof is omitted.

Contact holes reaching the source region 1604*a* and drain region 1604*c* of the driving transistor 1601 are formed in the interlayer film 1606. Then a laminate consisting of a Ti layer, an Al layer containing Ti, and another Ti layer is formed. Subsequently, a transparent conductive film, typically, an ITO film is formed. The laminate consisting of a Ti layer, an Al layer containing Ti, and another Ti layer and the transparent conductive film, typically ITO film, are patterned into desired shapes to obtain wires 1607, 1608, and 1619, and a pixel electrode 1620. The pixel electrode 1620 serves as an anode of a light emitting element 1624.

Subsequently, an insulating film is formed from an acrylic or other organic resin materials. An opening is formed in the insulating film at a position that coincides with the position of the pixel electrode 1620 of the light emitting element 1624 to obtain an insulating film 1610. The opening has to have side walls tapered gently enough to avoid degradation, disconnection, and the like of the organic compound layer due to a level difference in the side walls of the opening.

An organic compound layer 1611 is formed and then an opposite electrode (cathode) 1612 of the light emitting element 1624 is formed from a laminate. The laminate has a cesium (Cs) film with a thickness of 2 nm or less and a silver (Ag) film layered thereon to a thickness of 10 nm or less. By forming the opposite electrode 1612 of the light emitting element 1624 very thin, light emitted from the organic compound layer 1611 transmits through the opposite electrode 1612 and exits in the direction opposite to the substrate 1600. Subsequently, a protective film 1613 is formed in order to protect the light emitting element 1624.

As has been described, a light emitting device that emits light in the direction opposite to the substrate 1600 can have an increased aperture ratio because light emitted from the light emitting element 1614 does not need to be observed through the driving transistor 1601 and other elements that are formed on the substrate 1600.

The pixel structured as shown in FIG. 17B can use the same photo mask to pattern the wire 1619 connected to the source region or drain region of the driving transistor, and to pattern the pixel electrode 1620. Therefore, compared to the pixel structured as shown in FIG. 17A, the number of photo masks required in the manufacturing process is reduced and the process is simplified.

This embodiment may be combined freely with Embodiment Mode and Embodiment 1.

Embodiment 3

In this embodiment, an appearance view of the light emitting device is described with reference to FIGS. 8A to 8B.

Figure 8A:
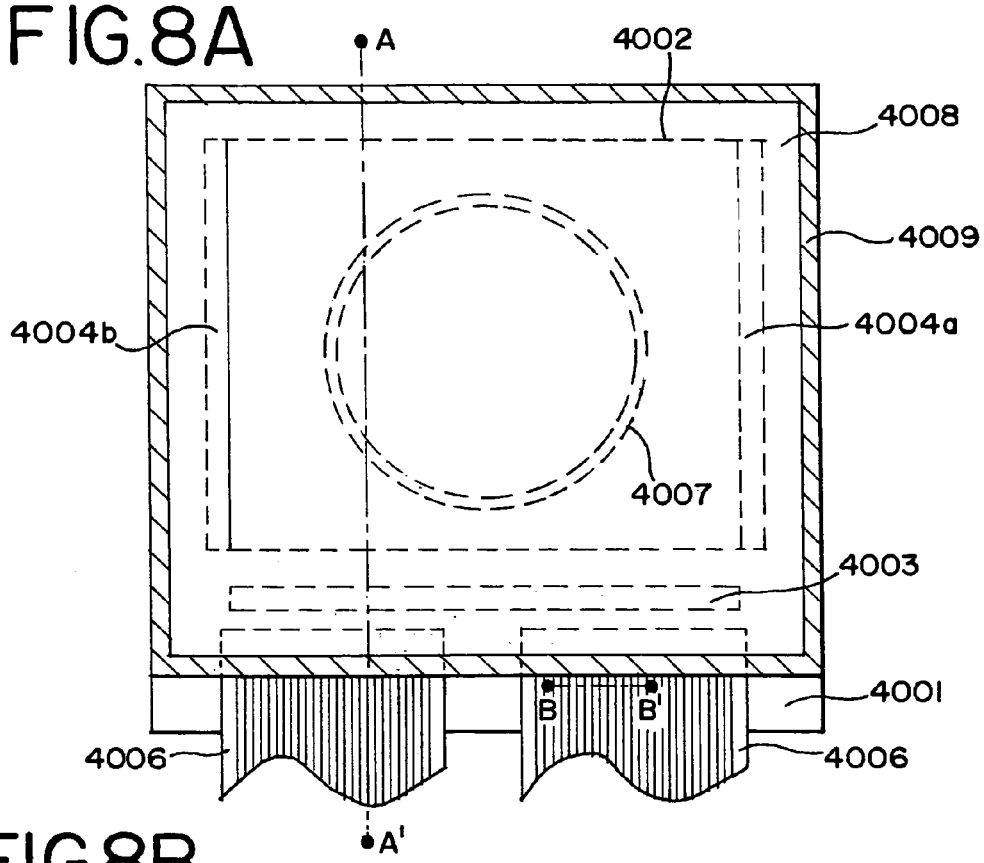
FIGS. 8A to 8C are diagrams showing a light emitting device of the present invention, with FIG. 8A showing the exterior of the device.
Figure 8B:
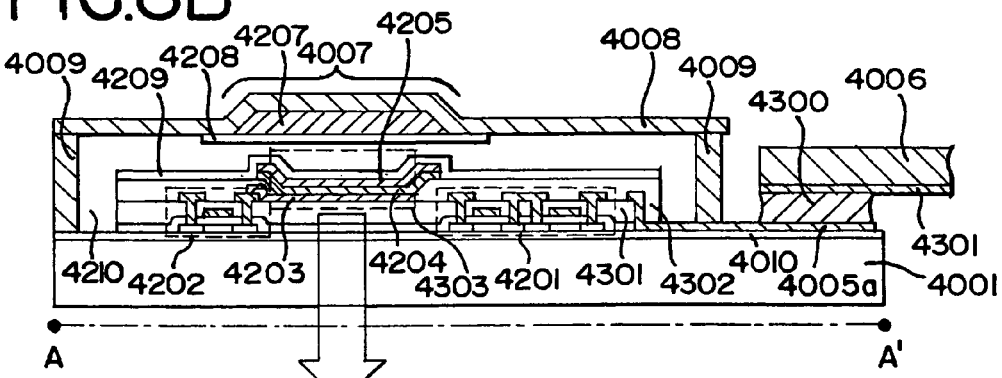
Figure 8C:
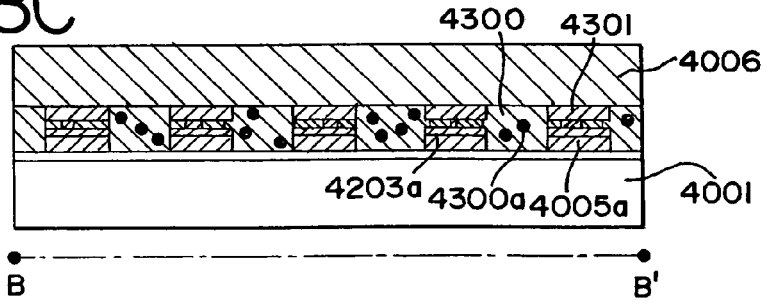

FIG. 8A is a top view of the light emitting device, FIG. 8B is a cross sectional view taken along with a line A-A' of FIG. 8A, and FIG. 8C is a cross sectional view taken along with a line B-B' of FIG. 8A.

A seal member 4009 is provided so as to surround a pixel portion 4002, a source signal line driving circuit 4003, and the first and the second gate signal line driving circuits 4004*a*, 4004*b*, which are provided on a substrate 4001. Further, a sealing material 4008 is provided on the pixel section 4002, the source signal line driving circuit 4003, and the first and the second gate signal line driving circuits 4004*a*, 4004*b*. The pixel section 4002, the source signal line driving circuit 4003, and the first and the second gate signal line driving circuits 4004*a*, 4004*b* are sealed by the substrate 4001, the seal member 4009 and the sealing material 4008 together with a filler 4210.

Incidentally, a pair of (two) gate signal line driving circuits is formed on the substrate in this embodiment. However, present invention is not limited thereto, and the number of the gate signal line driving circuit and the source line driving circuit are arbitrary provided by a designer.

Further, the pixel section 4002, the source signal line driving circuit 4003, and the first and the second gate signal line driving circuits 4004*a*, 4004*b*, which are provided on the substrate 4001, have a plurality of transistors. In FIG. 8B, a transistor for driving circuit (however, n-channel transistor and p-channel transistor are illustrated here) 4201 included in the source signal line driving circuit 4003 and a driving transistor (a transistor controlling current which flows to the light emitting element) 4202 included in the pixel section 4002, which are formed on a base film 4010, are typically shown.

In this embodiment, the p-channel transistor or the n-channel transistor formed by a known method is used as the transistor for driving circuit 4201 and the p-channel transistor formed by a known method is used as the driving transistor 4202. Further, the pixel section 4002 is provided with a storage capacitor (not shown) connected to a gate electrode of the driving transistor 4202.

An interlayer insulating film (planarization film) 4301 is formed on the transistor for driving circuit 4201 and the driving transistor 4202, and a pixel electrode (anode) 4203 electrically connected to a drain of the driving transistor 4202 is formed thereon. A transparent conductive film having a large work function is used for the pixel electrode 4203. A compound of indium oxide and tin oxide, a compound of indium oxide and zinc oxide, zinc oxide, tin oxide or indium oxide can be used for the transparent conductive film. The above transparent conductive film added with gallium may also be used.

Then, an insulating film 4302 is formed on the pixel electrode 4203, and the insulating film 4302 is formed with an opening portion on the pixel electrode 4203. In this opening portion, an organic compound layer 4204 is formed on the pixel electrode 4203. A known organic light emitting material or inorganic light emitting material may be used for the organic compound layer 4204. Further, there exist a low molecular weight (monomer) material and a high molecular weight (polymer) material as the organic light emitting materials, and both the materials may be used.

A known evaporation technique or application technique may be used as a method of forming the organic compound layer 4204. Further, the structure of the organic compound layer may take a lamination structure or a single layer structure by freely combining a hole injecting layer, a hole transporting layer, a light emitting layer, an electron transporting layer and an electron injecting layer.

A cathode 4205 made of a conductive film having light shielding property (typically, conductive film containing aluminum, copper or silver as its main constituent or lamination film of the above conductive film and another conductive film) is formed on the organic compound layer 4204. Further, it is desirable that moisture and oxygen which exist on an interface between the cathode 4205 and the organic compound layer 4204 are removed as much as possible. Therefore, such a device is necessary that the organic compound layer 4204 is formed in a nitrogen or rare gas atmosphere, and then, the cathode 4205 is formed without exposure to oxygen and moisture. In this embodiment, the above-described film deposition is enabled by using a multi-chamber type (cluster tool type) film forming device. In addition, a predetermined voltage is applied to the cathode 4205.

As described above, a light emitting element 4303 constituted of the pixel electrode (anode) 4203, the organic compound layer 4204 and the cathode 4205 is formed. Further, a protective film 4209 is formed on the insulating film 4302 so as to cover the light emitting element 4303. The protective film 4209 is effective in preventing oxygen, moisture and the like from permeating the light emitting element 4303.

Reference numeral 4005*a* denotes a wiring drawn to be connected to the power supply line, and the wiring 4005*a* is electrically connected to a source region of the driving transistor 4202. The drawn wiring 4005*a* passes between the seal member 4009 and the substrate 4001, and is electrically connected to an FPC wiring 4301 of an FPC 4006 through an anisotropic conductive film 4300.

A glass material, a metal material (typically, stainless material), a ceramics material or a plastic material (including a plastic film) can be used for the sealing material 4008. As the plastic material, an FRP (fiberglass-reinforced plastics) plate, a PVF (polyvinyl fluoride) film, a Mylar film, a polyester film or an acrylic resin film may be used. Further, a sheet with a structure in which an aluminum foil is sandwiched with the PVF film or the Mylar film can also be used.

However, in the case where the light from the light emitting element is emitted toward the cover member side, the cover member needs to be transparent. In this case, a transparent substance such as a glass plate, a plastic plate, a polyester film or an acrylic film is used.

Further, in addition to an inert gas such as nitrogen or argon, an ultraviolet curable resin or a thermosetting resin may be used as the filler 4103, so that PVC (polyvinyl chloride), acrylic, polyimide, epoxy resin, silicone resin, PVB (polyvinyl butyral) or EVA (ethylene vinyl acetate) can be used. In this embodiment, nitrogen is used for the filler.

Moreover, a concave portion 4007 is provided on the surface of the sealing material 4008 on the substrate 4001 side, and a hygroscopic substance or a substance that can absorb oxygen 4207 is arranged therein in order that the filler 4103 is made to be exposed to the hygroscopic substance (preferably, barium oxide) or the substance that can absorb oxygen. Then, the hygroscopic substance or the substance that can absorb oxygen 4207 is held in the concave portion 4007 by a concave portion cover member 4208 such that the hygroscopic substance or the substance that can absorb oxygen 4207 is not scattered. Note that the concave portion cover member 4208 has a fine mesh form, and has a structure in which air and moisture are penetrated while the hygroscopic substance or the substance that can absorb oxygen 4207 is not penetrated. The deterioration of the light emitting element 4303 can be suppressed by providing the hygroscopic substance or the substance that can absorb oxygen 4207.

As shown in FIG. 8C, the pixel electrode 4203 is formed, and at the same time, a conductive film 4203*a* is formed so as to contact the drawn wiring 4005*a*.

Further, the anisotropic conductive film 4300 has conductive filler 4300*a*. The conductive film 4203*a* on the substrate 4001 and the FPC wiring 4301 on the FPC 4006 are electrically connected to each other by the conductive filler 4300*a* by heat-pressing the substrate 4001 and the FPC 4006.

An ammeter and a correction circuit of the light emitting device of the present invention are formed on a substrate (not shown), which is different from the substrate 4001, and are electrically connected to the power supply line and the cathode 4205, which are formed on the substrate 4001, via the FPC 4006.

Note that this embodiment can be implemented by being freely combined with Embodiment Mode and Embodiments 1 and 2.

Embodiment 4

Figure 9:
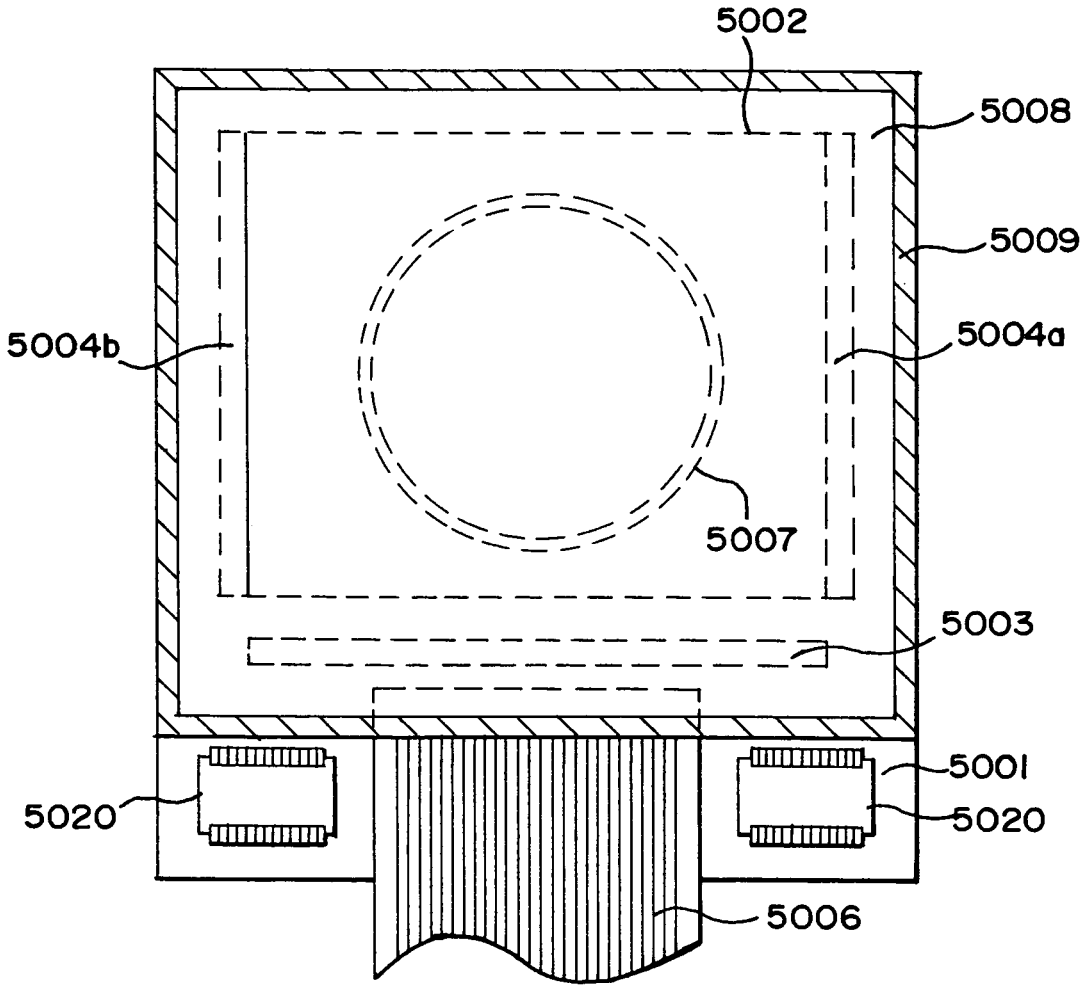
FIG. 9 is a diagram showing the exterior of a light emitting device of the present invention.

In this embodiment, an appearance view of the light emitting device, which is different from that in Embodiment 3, is described by using the present invention with reference to FIG. 9. More specifically, an appearance view of the light emitting device is described in which the ammeter and the correction circuit are formed on a substrate different from the substrate on which the pixel portion is formed, and are connected to the wirings on the substrate on which the pixel portion is formed by a means such as a wire bonding method or a COG (chip-on-glass) method with reference to FIG. 9.

FIG. 9 is a diagram of an appearance of a light emitting device of this embodiment. A seal member 5009 is provided so as to surround a pixel portion 5002, a source line driving circuit 5003 and the first and the second gate signal line driving circuits 5004*a* and 5004*b* which are provided on a substrate 5001. Further, a sealing material 5008 is provided on the pixel portion 5002, the source signal line driving circuit 5003 and the first and the second gate signal line driving circuits 5004*a* and 5004*b*. Thus, the pixel portion 5002, the source signal line driving circuits 5003 and the first and the second gate signal line driving circuits 5004*a* and 5004*b* are sealed by the substrate 5001, the seal member 5009 and the sealing member 5008 together with a filler (not shown).

Note that, although two gate signal line driving circuits are formed on the substrate 5001 in this embodiment, present invention is not limited thereto. And the number of the gate signal line driving circuit and the source signal line driving circuit is arbitrary provided by designer.

A concave portion 5007 is provided on the surface of the sealing material 5008 on the substrate 5001 side, and a hygroscopic substance or a substance that can absorb oxygen is arranged therein.

A wiring (drawn wiring) drawn onto the substrate 5001 passes between the seal member 5009 and the substrate 5001, and is connected to an external circuit or element of the light emitting device through an FPC 5006.

The ammeter and the correction circuit are formed on a substrate (hereinafter referred to as chip) 5020 different from the substrate 5001. The chip 5020 is attached onto the substrate 5001 by the means such as the COG (chip-on-glass) method, and is electrically connected to the power supply line and a cathode (not shown) which are formed on the substrate 5001.

In this embodiment, the chip 5020 on which the ammeter, the variable power supply and the correction circuit are formed is attached onto the substrate 5001 by the wire bonding method, the COG method or the like. Thus, the light emitting device can be structured based on one substrate, and therefore, the device itself is made compact and also the mechanical strength is improved.

Note that, a known method can be applied with regard to a method of connecting the chip onto the substrate. Further, circuits and elements other than the ammeter and the correction circuit may be attached onto the substrate 5001.

This embodiment can be implemented by being freely combined with Embodiment Mode and Embodiments 1 to 3.

Embodiment 5

A light emitting device is self-luminous and therefore is superior in visibility in bright surroundings compared to liquid crystal display devices and has wider viewing angle. Accordingly, the light emitting device of the present invention can be applied to a display unit for electronic equipment in various kinds.

Examples of electronic appliance employing a light emitting device of the present invention are: a video camera; a digital camera; a goggle type display (head mounted display); a navigation system; an audio reproducing device (car audio, an audio component, and the like); a laptop computer, a game machine; a portable information terminal (a mobile computer, a cellular phone, a portable game machine, an electronic book, etc.); and an image reproducing device including a recording medium (specifically, an appliance capable of processing data in a recording medium such as a digital versatile disk (DVD) and having a display device that can display the image of the data). The light emitting device having a light emitting element is desirable particularly for a portable information terminal since its screen is often viewed obliquely and is required to have a wide viewing angle. Specific examples of the electronic devices are shown in FIGS. 10A to 10H.

Figure 10A:
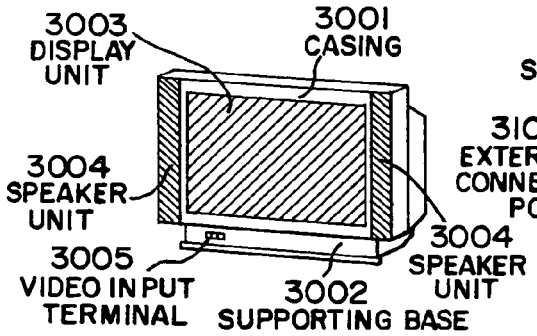
FIGS. 10A to 10H are diagrams showing examples of electronic equipment that has a light emitting device of the present invention.

FIG. 10A shows a light emitting device, which comprises a casing 3001, a supporting base 3002, a display unit 3003, speaker units 3004, a video input terminal 3005, etc. The light emitting device of the present invention is applied can be used for the display unit 3003. The light emitting device of the present invention is self-luminous and does not need a backlight, so that it can make a thinner display unit than liquid crystal display devices can. The term display device includes every display device for displaying information such as one for a personal computer, one for receiving TV broadcasting, and one for advertisement.

Figure 10B:
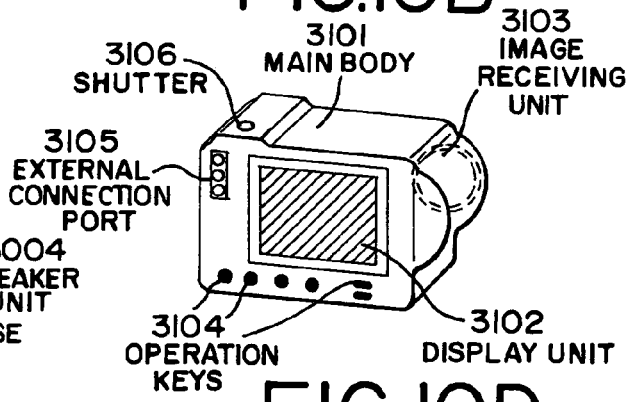

FIG. 10B shows a digital still camera, which comprises a main body 3101, a display unit 3102, an image receiving unit 3103, operation keys 3104, an external connection port 3105, a shutter 3106, etc. The digital still camera is formed by using the light emitting device of the present invention to the display unit 3102.

Figure 10C:
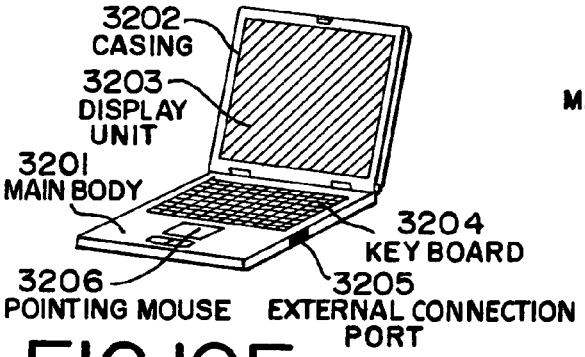

FIG. 10C shows a laptop computer, which comprises a main body 3201, a casing 3202, a display unit 3203, a keyboard 3204, an external connection port 3205, a pointing mouse 3206, etc. The laptop computer is formed by using the light emitting device of the present invention to the display unit 3203.

Figure 10D:
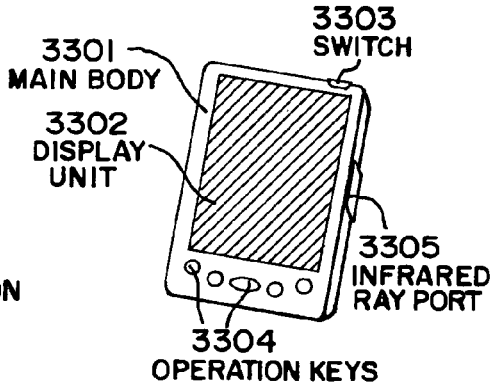

FIG. 10D shows a mobile computer, which comprises a main body 3301, a display unit 3302, a switch 3303, operation keys 3304, an infrared ray port 3305, etc. The mobile computer is formed by using the light emitting device of the present invention to the display unit 3302.

Figure 10E:
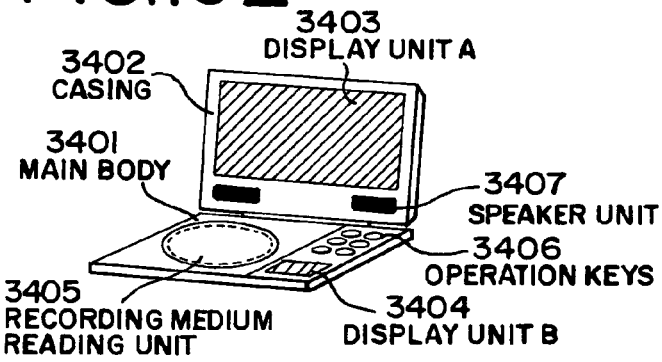

FIG. 10E shows a portable image reproducing device equipped with a recording medium (a DVD player, to be specific). The device comprises a main body 3401, a casing 3402, a display unit A 3403, a display unit B 3404, a recording medium (such as DVD) reading unit 3405, operation keys 3406, speaker units 3407, etc. The display unit A 3403 mainly displays image information whereas the display unit B 3404 mainly displays text information. The portable image reproducing device is formed by using the light emitting device of the present invention to the display units A 3403 and B 3404. The term image reproducing device equipped with a recording medium includes domestic game machines.

Figure 10F:
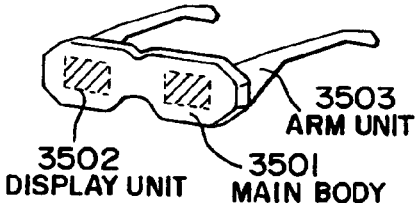

FIG. 10F shows a goggle type display (head mounted display), which comprises a main body 3501, display units 3502, and arm units 3503. The goggle type display is formed by using the light emitting device of the present invention to the display unit 3502.

Figure 10G:
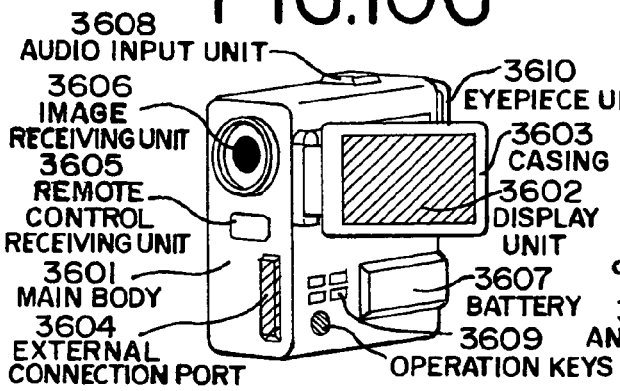

FIG. 10G shows a video camera, which comprises a main body 3601, a display unit 3602, a casing 3603, an external connection port 3604, a remote control receiving unit 3605, an image receiving unit 3606, a battery 3607, an audio input unit 3608, operation keys 3609, etc. The video camera is formed by using the light emitting device of the present invention to the display unit 3602.

Figure 10H:
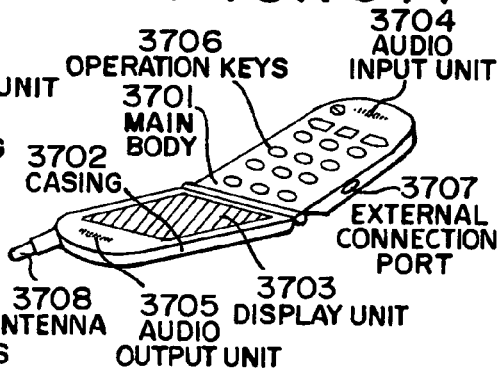
Figure 11A:
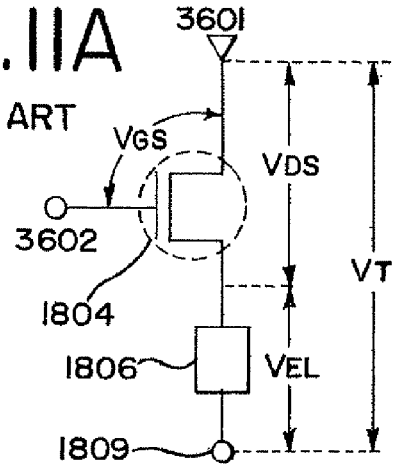
FIG.11A PRIOR ART
FIGS. 11A and 11B are a diagram showing a connection structure of a light emitting element and driving transistor and a diagram showing voltage-current characteristics of the light emitting element and driving transistor, respectively.
Figure 11B:
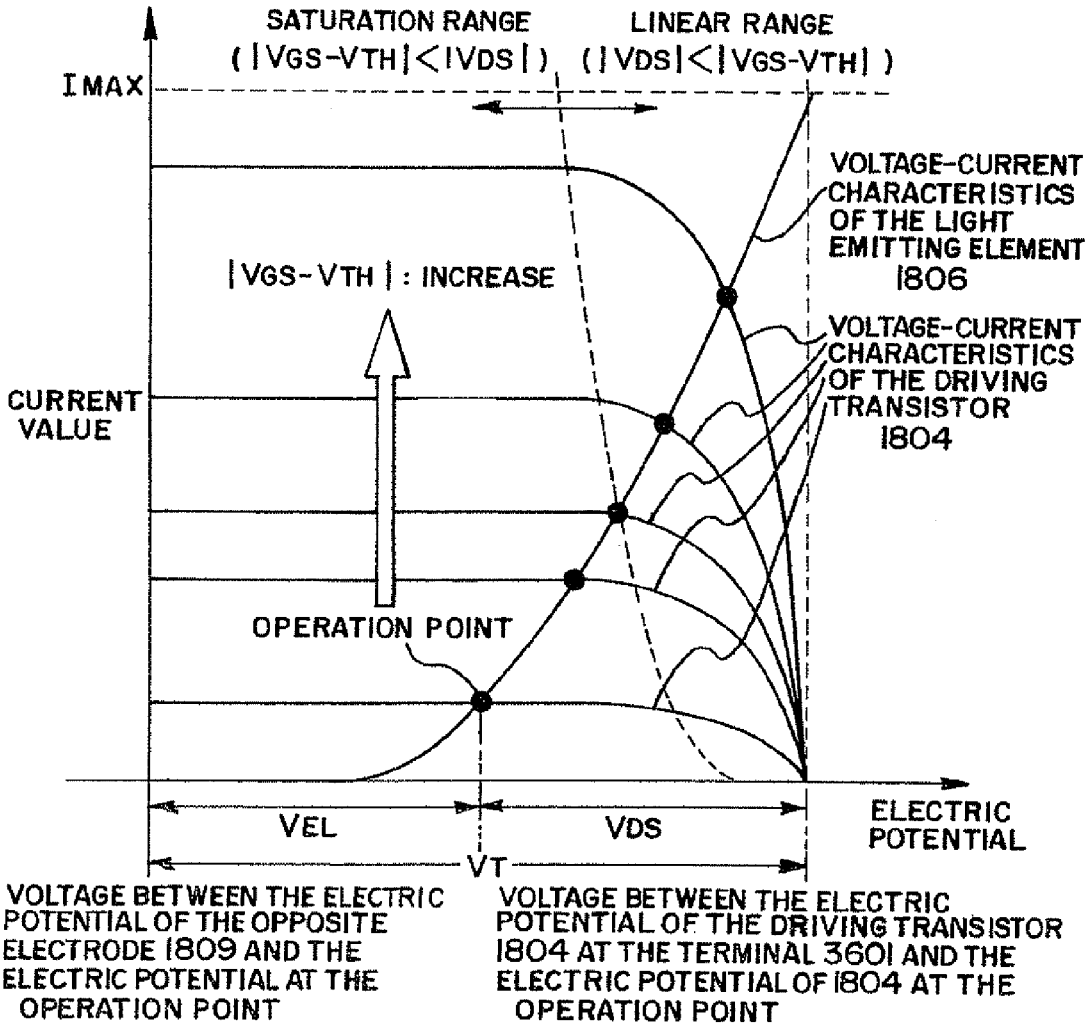
FIG.11B PRIOR ART
Figure 12:
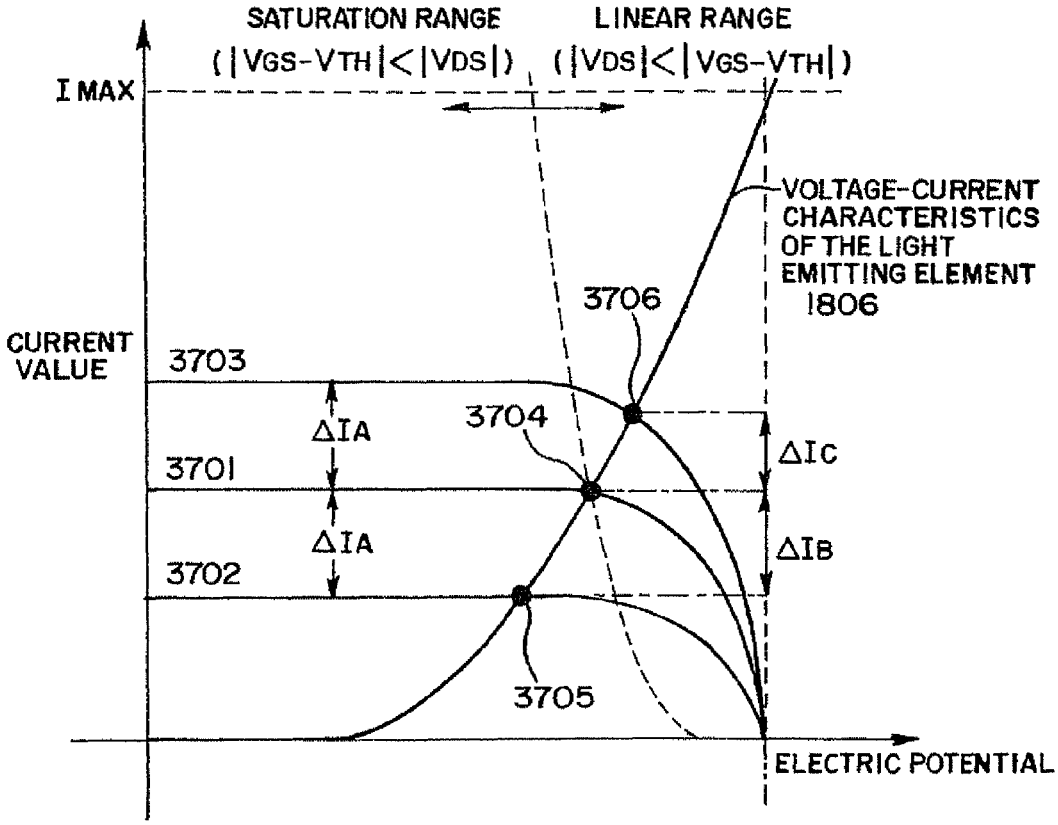
FIG. 12 PRIOR ART
FIG. 12 is a diagram showing voltage-current characteristics of a light emitting element and driving transistor.
Figure 13:
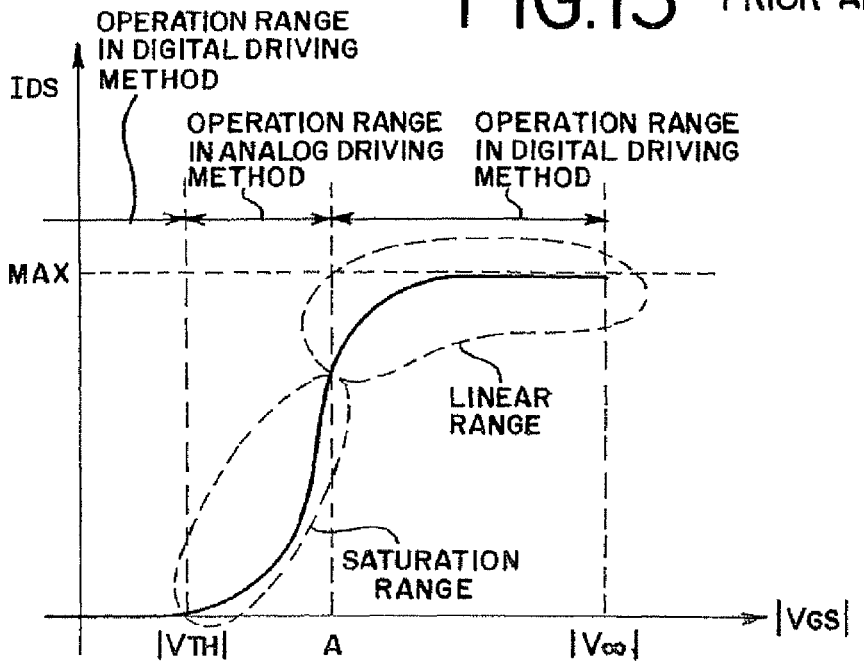
FIG. 13 PRIOR ART
FIG. 13 is a diagram showing the relation between the gate voltage and drain current of a driving transistor.
Figure 14:
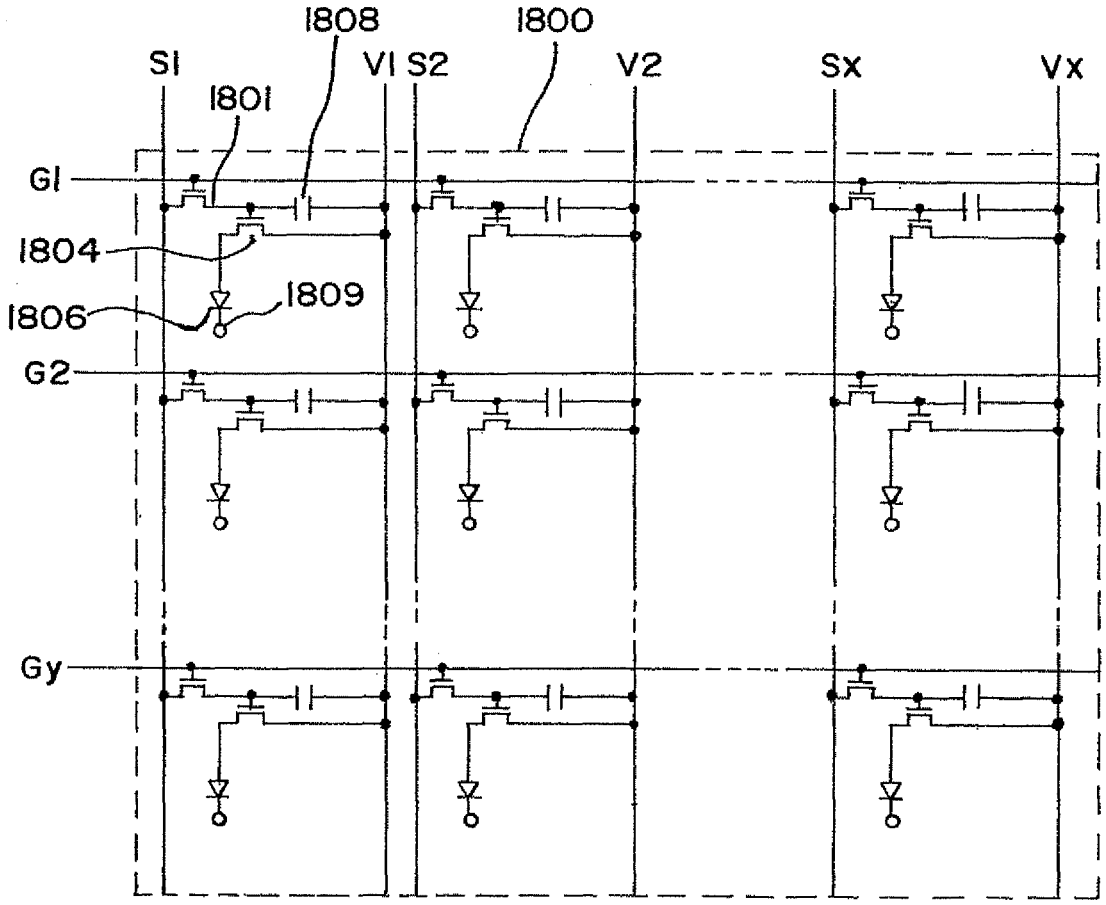
FIG. 14 PRIOR ART
FIG. 14 is a circuit diagram of a pixel portion in a light emitting device.
Figures 15A, 15B:
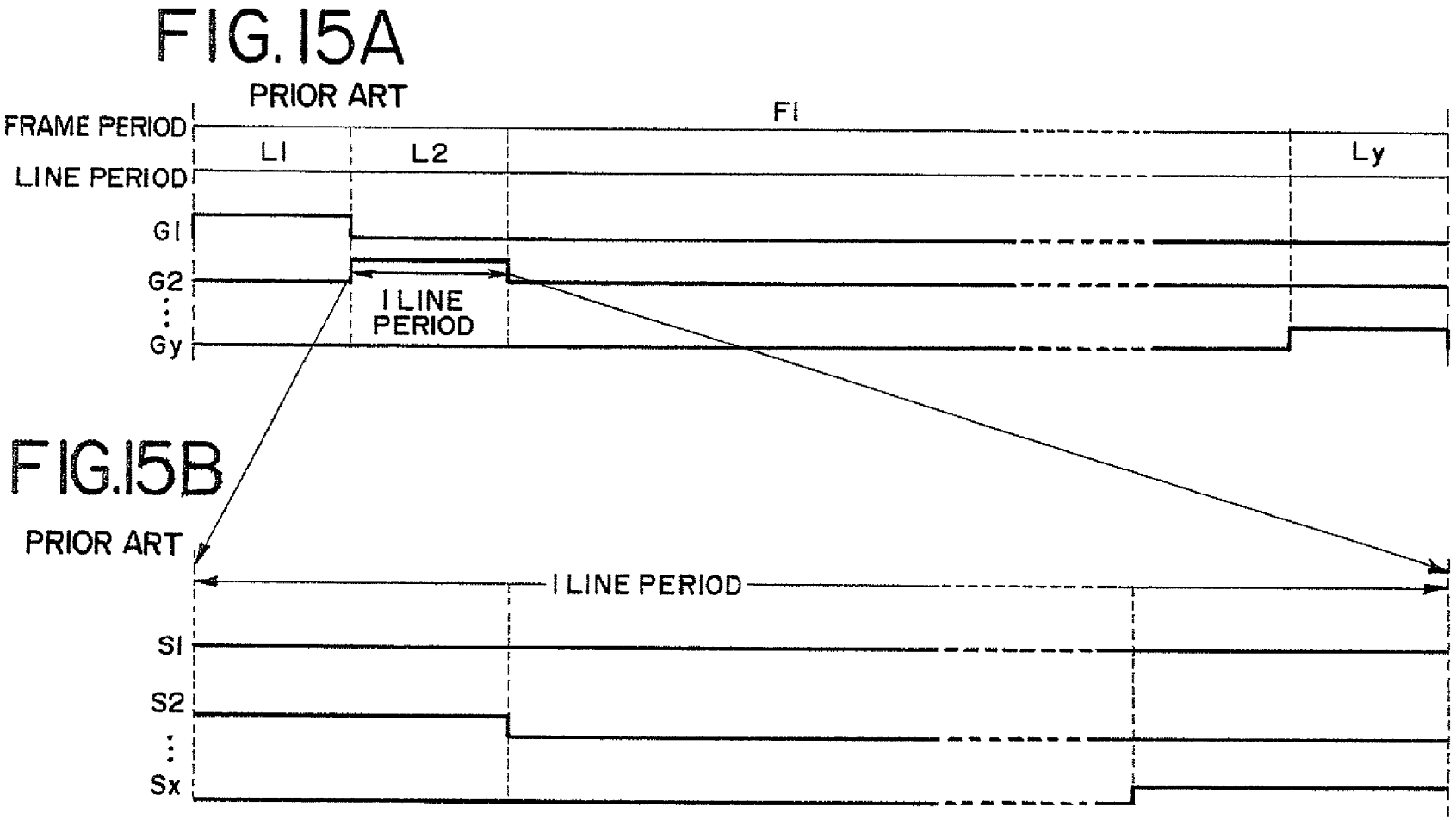
FIG.15A PRIOR ART
FIG.15B PRIOR ART
FIGS. 15A and 15B are timing charts of signals inputted to a light emitting device.

FIG. 10H shows a cellular phone, which comprises a main body 3701, a casing 3702, a display unit 3703, an audio input unit 3704, an audio output unit 3705, operation keys 3706, an external connection port 3707, an antenna 3708, etc. The cellular phone is formed by using the light emitting device of the present invention to the display unit 3703. If the display unit 3703 displays white characters on a black background, power consumption of the cellular phone can be reduced.

If the luminance of light emitted from organic materials is increased in future, the light emitting device of the present invention can be used also in a front or rear projector in which light bearing outputted image information is magnified by a lens or the like to be projected on a screen.

The electronic device given in the above often displays information distributed through electronic communication lines such as Internet and CATV (cable television), especially, animation information with increasing frequency. The light emitting device of the present invention is suitable for displaying animation information since organic materials have fast response speed.

In the light emitting device, portions that emit light consume power. Therefore it is desirable to display information such that as small portions as possible emits light. Accordingly, if the light emitting device is used for a display unit that mainly displays text information such as a portable information terminal, in particular, a cellular phone, and an audio reproducing device, it is desirable to assign light emitting portions to display text information while portions that do not emit light serve as the background.

As described above, the application range of the light emitting device to which the present invention is applied is very wide and electronic appliances of various fields can employ the device.

The present invention calculates video signals suited to characteristics of driving transistors of the respective pixels without changing the structure of the pixels. The obtained video signals are inputted to the pixels to cause a current to flow in a light emitting element in a desired amount, and therefore light emission as desired can be obtained. As a result, a light emitting device and its driving method which remove influence of fluctuation in characteristic among transistors for controlling light emitting elements are provided.

The present invention structured as above can provide a light emitting device and its driving method in which the light emitting device is driven by an analog method and influence of fluctuation in characteristic among transistors is removed to obtain clear multi-gray scale display. Furthermore, the present invention can provide a light emitting device and its driving method in which a change with age in amount of current flowing between two electrodes of a light emitting element is reduced to obtain clear multi-gray scale display.

What is claimed is:

1. A method of driving a light emitting device, comprising:

inputting a first signal having a first potential $P_0$ to each of a plurality of pixels;

obtaining a first current value $I_0$ of all of the plurality of pixels after inputting the first signal to each of the plurality of pixels;

inputting a second signal having a second potential $P_1$ to a first pixel of the plurality of pixels;

obtaining a second current value $I_1$ of all of the plurality of pixels after inputting the second signal to the first pixel;

inputting a third signal $P_2$ having a third potential to the first pixel;

obtaining a third current value $I_2$ of all of the plurality of pixels after inputting the third signal $P_2$ to the first pixel;

calculating a current value $Q_1$ and a current value $Q_2$ which are $Q_1=I_1-I_0$ and $Q_2=I_2-I_0$;

obtaining an interpolation function F from two sets of data $(P, Q)=(P_1, Q_1)$ and $(P_2, Q_2)$; and storing constants in the interpolation function F to a storage medium in the light emitting device, wherein the first current value $I_0$ is a current value of when each of the plurality of pixels does not emit light.

2. The method of driving the light emitting device according to claim 1, wherein the first current value $I_0$, the second current value $I_1$, and the third current value $I_2$ are obtained before shipping the light emitting device.

3. The method of driving the light emitting device according to claim 1, wherein the first current value $I_0$ and the second current value $I_1$ are obtained by measuring a current flowing through a cathode line electrically connected to cathode electrodes of light emitting elements of the plurality of pixels.

4. A method of driving a light emitting device, comprising:

inputting a first signal having a first potential $P_0$ to each of a plurality of pixels;

obtaining a first current value $I_0$ of all of the plurality of pixels after inputting the first signal to each of the plurality of pixels;

inputting a second signal having a second potential $P_1$ to a first pixel of the plurality of pixels;

obtaining a second current value $I_1$ of all of the plurality of pixels after inputting the second signal to the first pixel;

inputting a third signal $P_2$ having a third potential to the first pixel;

obtaining a third current value $I_2$ of all of the plurality of pixels after inputting the third signal $P_2$ to the first pixel;

calculating a current value $Q_1$ and a current value $Q_2$ which are $Q_1=I_1-I_0$ and $Q_2=I_2-I_0$;

obtaining an interpolation function F from two sets of data $(P, Q)=(P_1, Q_1)$ and $(P_2, Q_2)$; and storing constants in the interpolation function F to a storage medium in the light emitting device, wherein the first potential is different from the second potential, and wherein the first current value $I_0$ is a current value of when each of the plurality of pixels does not emit light.

5. The method of driving the light emitting device according to claim 4, wherein the first current value $I_0$, the second current value $I_1$, and the third current value $I_2$ are obtained before shipping the light emitting device.

6. The method of driving the light emitting device according to claim 4, wherein the first current value $I_0$ and the second current value $I_1$ are obtained by measuring a current flowing through a cathode line electrically connected to cathode electrodes of light emitting elements of the plurality of pixels.

* * * * *